US007464818B2

(12) United States Patent
Gherdan et al.

(10) Patent No.: US 7,464,818 B2
(45) Date of Patent: Dec. 16, 2008

(54) CHILD RESISTANT AND SENIOR FRIENDLY MEDICAMENT STORAGE AND DISTRIBUTION PACKAGE

(75) Inventors: Victor Gherdan, Cherry Hill, NJ (US); David Barndt, Richlandtown, PA (US); Tim Craig, Bensalem, PA (US)

(73) Assignee: R.P. Scherer Technologies, Inc., Las Vegas, NV (US)

( * ) Notice: Subject to any disclaimer, the term of this patent is extended or adjusted under 35 U.S.C. 154(b) by 650 days.

(21) Appl. No.: 11/250,310

(22) Filed: Oct. 14, 2005

(65) Prior Publication Data

US 2007/0084747 A1 Apr. 19, 2007

(51) Int. Cl.
*B65D 83/04* (2006.01)

(52) U.S. Cl. ..... 206/531; 206/532

(58) Field of Classification Search ..... 206/528, 206/531, 532, 538, 828
See application file for complete search history.

(56) References Cited

U.S. PATENT DOCUMENTS

| | | | | |
|---|---|---|---|---|
| 3,941,248 | A | 3/1976 | Moser et al. | 206/531 |
| RE29,705 | E | 7/1978 | Compere | 206/531 |
| 4,243,144 | A | 1/1981 | Margulies | 206/532 |
| 4,988,004 | A | 1/1991 | Intini | 206/532 |
| 5,046,618 | A | 9/1991 | Wood | 206/532 |
| 5,358,118 | A | 10/1994 | Thompson et al. | 206/538 |
| 2004/0182739 | A1 | 9/2004 | Williams-Hartman | 206/531 |
| 2005/0023180 | A1 | 2/2005 | Intini | 206/532 |

*Primary Examiner*—J. Gregory Pickett
(74) *Attorney, Agent, or Firm*—Fitzpatrick, Cella, Harper & Scinto

(57) ABSTRACT

A child resistant senior friendly medication storage and distribution package including a blister portion and a blocking substrate sandwiched between a dispensing substrate and a backing substrate. The procedure to access the medicament is easy for an adult to understand and accomplish, yet difficult for most children. The blister portion contains a base layer and a blister layer. The blister layer includes an article receiving blister designed for holding the medicament. The dispensing substrate has a dispensing substrate blister receiver. The blister receiver is configured to cooperate with the blister so it extends through the dispensing substrate. The blocking substrate includes a gate that initially covers a portion of the blister. The gate must be moved, or slid, out of the way in order to eject the medicament. The user applies a force to the gate causing it to translate between the backing substrate and the dispensing substrate.

31 Claims, 16 Drawing Sheets

CHILD RESISTANT AND SENIOR FRIENDLY MEDICAMENT STORAGE AND DISTRIBUTION PACKAGE

TECHNICAL FIELD

The present invention generally relates to medication packages and, more particularly, relates to child resistant and senior friendly medication packages that incorporate a sliding gate type component to control access to the dosage forms.

BACKGROUND OF THE INVENTION

There is a continued need for medication packages that are child resistant and tamper evident, yet allow the average adult to open the medication packages to get access to the medication therein, as well as the adult who, due to either age or medical infirmity, may have reduced motor skills. Such packaging has been called "child resistant senior friendly." There is also a need to make this type of package economical to manufacture.

Over the years, a wide variety of disposable medication packages have been suggested which are accessible through a variety of folding, stripping, rupturing, peeling, and/or tearing procedures. These packages have typically been formed of transparent top layers which are sealed or otherwise bonded to backing layers in a manner which provides a cavity, pouch or "blister" in which the medicament is disposed. The top and backing layers may be formed of flexible packaging materials, rigid thermoformable plastic materials, foil, paper, laminates, or combinations thereof. Medicament cavities formed between such layers have been accessed by tearing into them from an edge of the package, which tearing may or may not be facilitated through the provision of a starting notch or slit, or by simply pushing on the blister until the medicament breaks through the backing layer. Alternatively, these cavities may be accessed by stripping a backing layer from the package to expose the cavity, or to expose a push-through underlayer. In other instances, the backing layer is made of foil that can be ruptured when the medication in the blister is pushed against the backing layer. Generally, these packages are tamper evident, but typically not child resistant. Other medication packages require some form of peeling of the bottom surface from the top surface to get access to the medication. Some examples of these types of medication packages that use peeling include U.S. Pat. No. RE29,705 (Compere); U.S. Pat. No. 3,941,248 (Moser); U.S. Pat. No. 4,243,144 (Margulies); U.S. Pat. No. 4,988,004 (Intini); U.S. Pat. No. 5,046,618 (Wood); and U.S. Pat. No. 5,358,118 (Thompson).

Child resistant medication packages that use peeling have been in use for some time, however, many people who do not have sufficient motor skills or whose hands shake are not able to easily gain access to the medicament in such packages. This can be a problem especially when the medicament and the medication packages are small. Additionally, there have been a number of medication packages that are designed to be torn open to access the medication. Many medication packages that are designed to be torn suffer from the same problems as those designed for peeling, namely they are difficult to open for those with reduced motor skills or do not exhibit a high degree of child-resistance.

There is a need for a medication package that is relatively easy to open for an adult, but still be child resistant. Further, the package must be easy to manufacture without having to introduce custom machinery, so that the package remains economical. The present invention has accomplished these needs by creating a medication package that does not require fine motor skill functions, such as pinching and peeling. The present invention is relatively easy to open when a user identifies the sequence required to open the package, yet is extremely difficult to open in any other fashion, thereby avoiding some of the inherent problems of prior medication packages.

SUMMARY OF THE INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The child resistant medicament storage and distribution package of the present invention is designed for housing a medicament regardless of shape or size. The package includes a blister portion and a blocking substrate, both sandwiched between a dispensing substrate and a backing substrate. The arrangement of these four primary components is unique and requires the execution of a specific procedure to access the medicament. The required procedure is easy for an adult to understand and accomplish, yet is difficult for most children to understand and accomplish; thus imparting a degree of child resistance previously unavailable, while remaining senior friendly.

The blister portion contains a base layer and a blister layer. The blister layer is formed to include an article receiving blister designed for holding the medicament. The base layer may be comprised of one or more separate layers of material, such as foil and polyester or other suitable child resistant foil. Generally, at least five percent, more preferably at ten percent and most preferably at least fifteen percent of the surface area of a base layer interior surface is joined to a blister layer interior surface thereby sealing the medicament in the article receiving blister. The area of the blister layer that is formed into the article receiving blister or bubble is not joined to the base layer.

The dispensing substrate is formed to have a dispensing substrate blister receiver and a dispensing substrate initiation region. The dispensing substrate blister receiver is configured to cooperate with the blister portion such that a portion of the article receiving blister extends through the dispensing substrate. The dispensing substrate initiation region is an area that may be used to transfer a force to the blocking substrate or as an area that a portion of the blocking substrate may pass through.

The blocking substrate includes a gate having a gate free edge and a gate retaining edge. The gate is generally rectangular in shape with three of the sides being free from the surrounding blocking substrate, and the forth side, referred to as the gate retaining edge being connected to, or integral with, the surrounding blocking substrate. The gate is positioned such that initially a portion of the gate covers, or blocks, the article receiving blister. As such, the gate must be moved, or slid, out of the way in order to eject the medicament from the article receiving blister.

The backing substrate is formed to have a backing substrate initiation region and an article dispensing region. The backing substrate initiation region may be identical to the dispensing substrate initiation region, previously discussed. The article dispensing region is configured to cooperate with the blister portion. In other words, the article receiving blister and the article dispensing region must generally align such that when the medicament is ejected from the article receiving blister and the gate is out of the way, that the medicament may pass through the article dispensing region.

The assembly and orientation of the various elements of the package imparts the desired functionality to achieve the predetermined sequence of operation necessary to open the package. To dispense the medicament from the package requires application of a first force to a portion of the gate resulting in the gate free edge sliding toward the gate retaining edge and past the article dispensing region. Generally, the first force will be applied by a tip of a human digit, most likely the thumb. The first force may be applied from the backing substrate side of the package or may alternatively be applied from the dispensing substrate side of the package. The first force must only be significant enough to force a portion of the gate out either the dispensing substrate initiation region or the backing substrate initiation region. The gate may incorporate a fold promoting characteristic that minimizes the distance that the gate must be forced orthogonally away from the package.

Thus, there is disclosed a medicament storage and distribution package for housing a medicament, comprising:

(a) a blister portion having:

(1) a base layer having a base layer perimeter, a base layer exterior surface, and a base layer interior surface; and, (2) a blister layer having a blister layer perimeter, a blister layer exterior surface, a blister layer interior surface, and including an article receiving blister, having a blister perimeter, formed therein, wherein the article receiving blister is designed for holding the medicament; wherein (3) at least five percent of the surface area of the base layer interior surface is joined to the blister layer interior surface thereby sealing the medicament in the article receiving blister;

(b) a dispensing substrate having a dispensing substrate perimeter, a dispensing substrate interior surface, and a dispensing substrate exterior surface, wherein the dispensing substrate is formed to have:

(1) a dispensing substrate blister receiver configured to cooperate with the blister portion such that a portion of the article receiving blister extends through the dispensing substrate from the dispensing substrate interior surface to the dispensing substrate exterior surface; and (2) a dispensing substrate initiation region;

(c) a blocking substrate having a blocking substrate perimeter, a blocking substrate front surface, and a blocking substrate rear surface, wherein the blocking substrate includes a gate having a gate perimeter including a gate free edge and a gate retaining edge;

(d) a backing substrate having a backing substrate perimeter, a backing substrate interior surface, and a backing substrate exterior surface, wherein the backing substrate is formed to have:

(1) a backing substrate initiation region; and (2) an article dispensing region having an article dispensing region perimeter, wherein the article dispensing region is configured to cooperate with the blister portion; and (e) wherein the blister portion blister layer is adjacent to the dispensing substrate interior surface, the blocking substrate front surface is adjacent to the blister portion base layer, and the backing substrate interior surface is adjacent to the blocking substrate rear surface such that the dispensing substrate blister receiver, the article receiving blister, and the article dispensing region substantially align, and the gate is initially located between the article dispensing region and the article receiving blister to prevent unintentional dispensing of the medicament, such that dispensing of the medicament requires application of a first force to a portion of the gate resulting in the gate free edge sliding toward the gate retaining edge and past the article dispensing region such that application of a second force to the article receiving blister forces the medicament to break through the base layer, pass through an opening in the blocking substrate created by the movement of the gate, and out the article dispensing region.

There is further disclosed a medicament storage and distribution package for housing a medicament, comprising:

(a) a blister portion having:

(1) a base layer having a base layer perimeter, a base layer exterior surface, and a base layer interior surface;

(2) a blister layer having a blister layer perimeter, a blister layer exterior surface, a blister layer interior surface, and including an article receiving blister, having a blister perimeter, formed therein, wherein the article receiving blister is designed for holding the medicament; wherein (3) at least five percent of the surface area of the base layer interior surface is joined to the blister layer interior surface thereby sealing the medicament in the article receiving blister;

(b) a dispensing substrate having a dispensing substrate perimeter, a dispensing substrate interior surface, and a dispensing substrate exterior surface, wherein the dispensing substrate is formed to have:

(1) a dispensing substrate blister receiver configured to cooperate with the blister portion such that a portion of the article receiving blister extends through the dispensing substrate from the dispensing substrate interior surface to the dispensing substrate exterior surface; and (2) a dispensing substrate initiation region, sized to cooperate with the dimensions of a tip of a human finger, integral to the dispensing substrate and having a dispensing substrate initiation region perimeter with (a) a portion that is a dispensing substrate initiation region retaining edge that secures the dispensing substrate initiation region to the dispensing substrate and serves as a line about which the dispensing substrate initiation region may pivot, and (b) a portion that is a dispensing substrate initiation region breakaway edge that initially secures the dispensing substrate initiation region to the dispensing substrate until acted upon by a force of a predetermined magnitude that causes the breakaway edge to release from the remainder of the dispensing substrate;

(c) a blocking substrate having a blocking substrate perimeter, a blocking substrate front surface, and a blocking substrate rear surface, wherein the blocking substrate includes a gate having a gate perimeter including a gate free edge and a gate retaining edge, wherein the gate has a fold promoting characteristic that causes the gate to begin to fold about the fold promoting characteristic when the gate is displaced out of the plane of the package by the first force, thereby creating a pivot projection that is easily pivoted about the gate retaining edge and away from the article receiving blister drawing the gate free edge past the article receiving blister to permit dispensing of the medicament;

(d) a backing substrate having a backing substrate perimeter, a backing substrate interior surface, and a backing substrate exterior surface, wherein the backing substrate is formed to have:

(1) a backing substrate initiation region, sized to cooperate with the dimensions of a tip of a human finger, integral to the backing substrate and having a backing substrate initiation region perimeter with (a) a portion that is a backing substrate initiation region retaining edge that secures the backing substrate initiation region to the backing substrate and serves as a line about which the backing substrate initiation region may pivot, and (b) a portion that is a backing substrate initiation region breakaway edge that initially secures the backing substrate initiation region to the backing substrate until acted upon by a force of a predetermined magnitude causing the breakaway edge to release from the remainder of the backing substrate; and (2) an article dispensing region having an article dispensing region perimeter, wherein the article dispensing region is configured to cooperate with the blister portion and the article dispensing region is an integral portion of the backing substrate having a separation line located substantially on the article dispensing region perimeter to selectively reducing the strength of the backing substrate, thereby permitting the medicament to break a portion of the article dispensing region free of the backing substrate along the separation line when the medicament is exposed to the second force, thereby permitting the medicament to pass through the article dispensing region for distribution; and (e) wherein the blister portion blister layer is adjacent to the dispensing substrate interior surface, the blocking substrate front surface is adjacent to the blister portion base layer, and the backing substrate interior surface is adjacent to the blocking substrate rear surface such that the dispensing substrate blister receiver, the article receiving blister, and the article dispensing region substantially align, and the gate is initially located between the article dispensing region and the article receiving blister to prevent unintentional dispensing of the medicament, such that dispensing of the medicament requires application of a first force to a portion of the gate resulting in the gate free edge sliding toward the gate retaining edge and past the article dispensing region such that application of a second force to the article receiving blister forces the medicament to break through the base layer, pass through an opening in the blocking substrate created by the movement of the gate, and out the article dispensing region.

Various objects and advantages of the present invention will become apparent from the following detailed description when viewed in conjunction with the accompanying drawings, which set forth certain embodiments of the invention.

BRIEF DESCRIPTION OF THE DRAWINGS

Without limiting the scope of the present invention as claimed below and referring now to the drawings and figures:

DETAILED DESCRIPTION OF THE INVENTION

The child resistant blister medicament storage and distribution package of the instant invention enables a significant advance in the state of the art. The preferred embodiments of the apparatus accomplish this by new and novel arrangements of elements that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
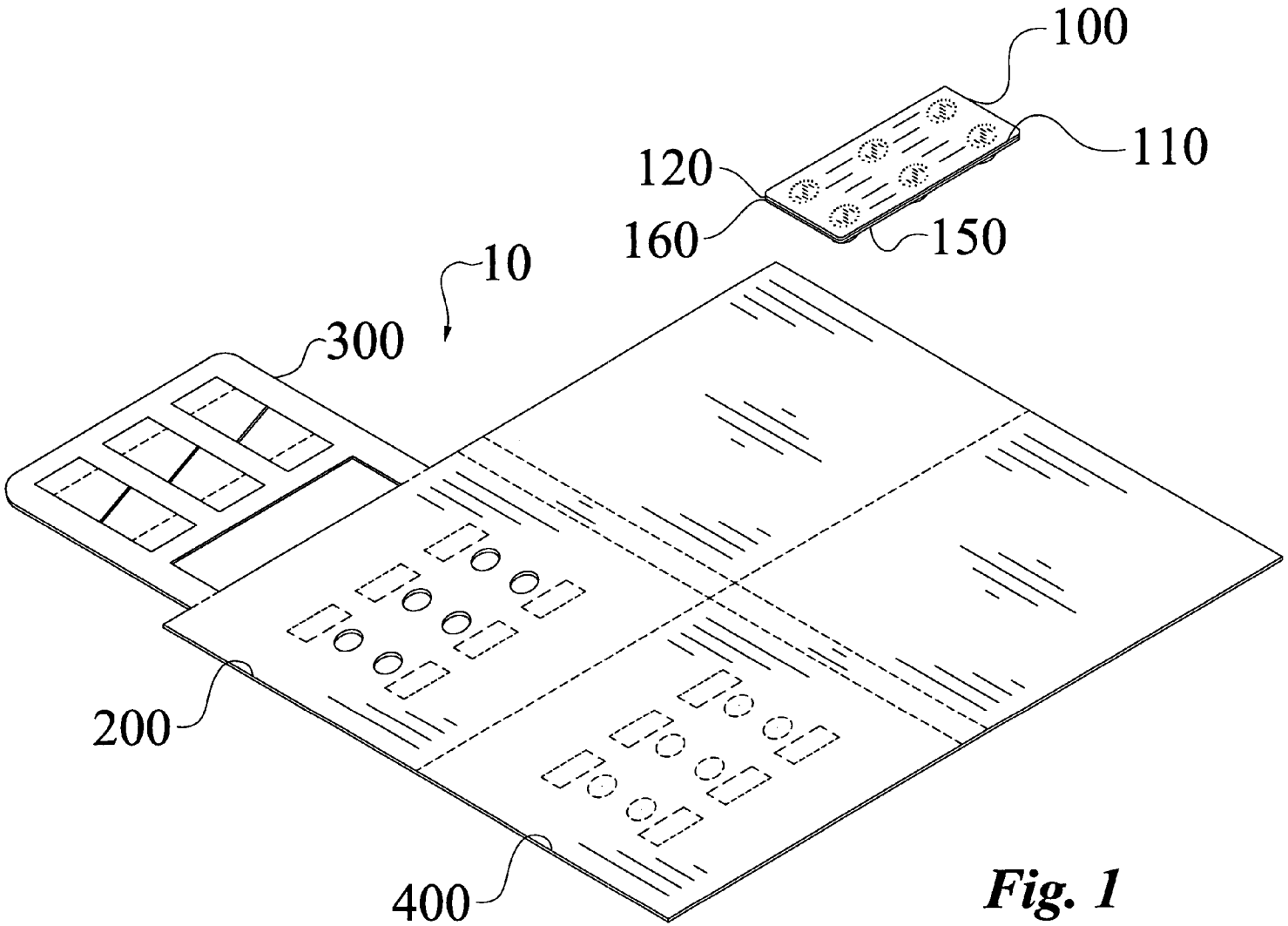
FIG. 1 is a perspective view of an embodiment of the child resistant senior friendly medicament storage and distribution package in accordance with the present invention.

From the figures, the child resistant medicament storage and distribution package (10) of the present invention is designed for housing a medicament (M) regardless of form, including, but not limited to, round pills, oval pills, oblong capsules, caplets, etc. As seen in FIG. 1, the package (10) includes a blister portion (100), a dispensing substrate (200), a blocking substrate (300), and a backing substrate (400). These four primary components are assembled in a unique way that requires the execution of a specific procedure to access the medicament (M), thereby imparting a degree of child resistance previously unavailable, while remaining senior friendly. The characteristics of the four primary components will be briefly described so that the sequence of operation may be explained.

First, the blister portion (100) contains a base layer (110) and a blister layer (150). The base layer (110) has a base layer perimeter (120), a base layer exterior surface (130), and a base layer interior surface (140), labeled in FIGS. 1 and 14. Similarly, the blister layer (150) has a blister layer perimeter (160), a blister layer exterior surface (170), and a blister layer interior surface (180), also labeled in FIGS. 1 and 15. The blister layer (150) is formed to include an article receiving blister (190) having a blister perimeter (196), best illustrated in FIG. 6. The article receiving blister (190) is formed with a sidewall (192) and an endwall (194) and is designed for holding the medicament (M), illustrated in FIG. 16.

The blister layer (150) is preferably made of pharmaceutical grade PVC or other thermoplastic material, such as plastic, polypropylene, polyethylene, styrene, cold-formed foil, or other suitable materials for packaging. The article receiving blister (190) may be formed by a thermoforming process in which the blister layer (150) material is stretched into a cavity with a vacuum technique to form the blister portion. In a preferred embodiment, a sheet of suitable material for the blister layer (150) is exposed to heating elements for a predetermined time. This sheet is then trapped in a forming station where it is subjected to both vacuum and pressure. During this process, the material may also be mechanically assisted into the blister cavity via a matched metal plug to form the article receiving blister (190). In another embodiment, the article receiving blister (190) may be formed by using cold-formed foil and cold-form packaging processes. As used herein, "blister package" includes medication packages made with cold-formed foil and using cold-form packaging processes. The base layer (110) may be comprised of one or more separate layers of material, such as foil and polyester or other suitable foils. The base layer (110) is typically comprised of multiple layers, but it could be made of any material.

Referring again to FIGS. 13-17, at least five percent, more preferably at least 10 percent, of the surface area of the base layer interior surface (130) is joined to the blister layer interior surface (180) thereby sealing the medicament (M) in the article receiving blister (190) up to 90 percent of the surface of the base layer can be joined to the blister layer interior surface. The blister layer (150) may be joined to the base layer (110) by heat sealing, adhesive such as heat-activated adhesive that has been pre-applied to the base layer (110) or solvent adhesive, radio frequency or sonic seal, or by other suitable means. The area of the blister layer (150) that is formed into the article receiving blister (190) is not joined to the base layer (100). The blister layer perimeter (160) generally corresponds to the base layer perimeter (120).

Figure 2:
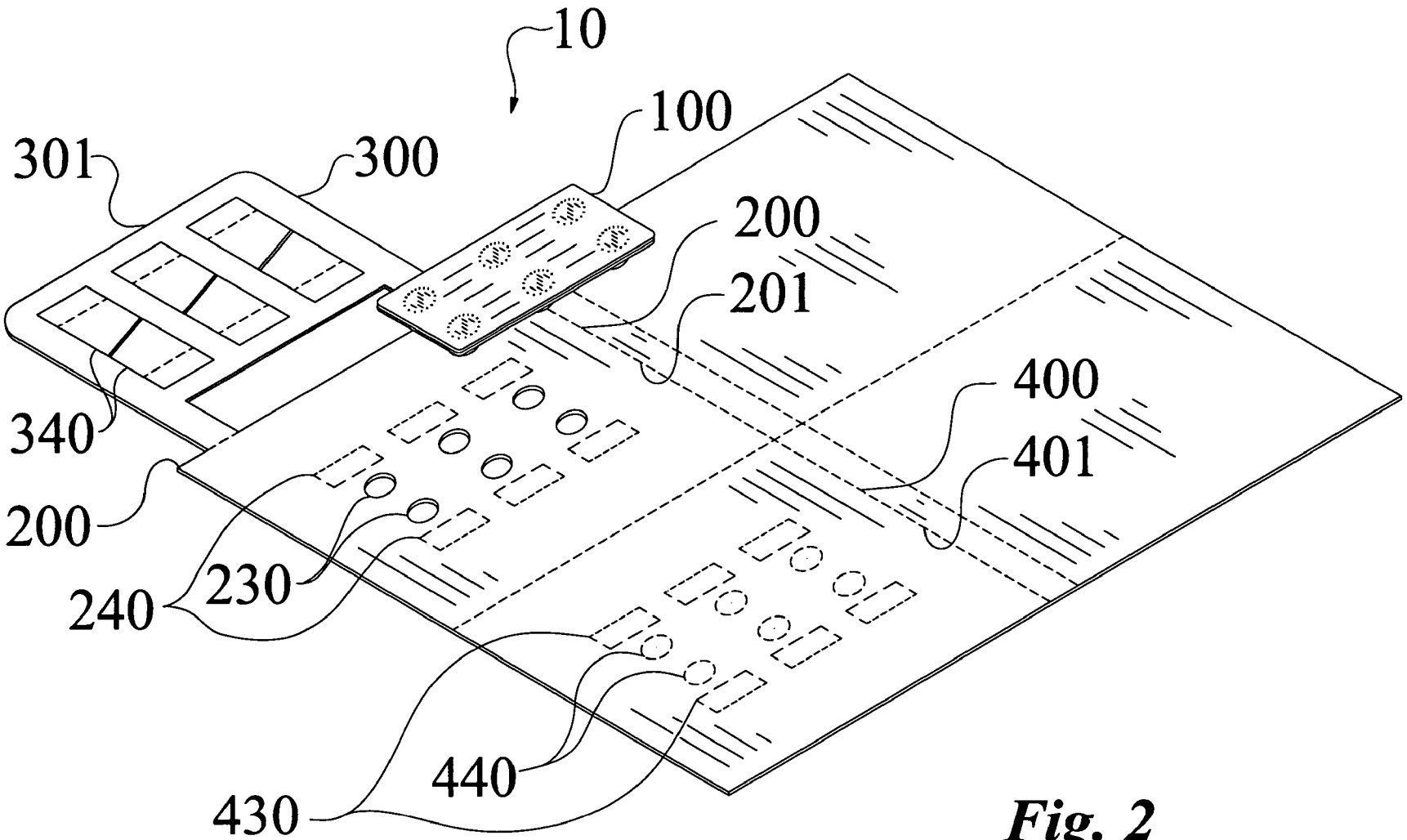
FIG. 2 is a perspective view of an embodiment of the child resistant senior friendly medicament storage and distribution package in accordance with the present.
Figure 3:
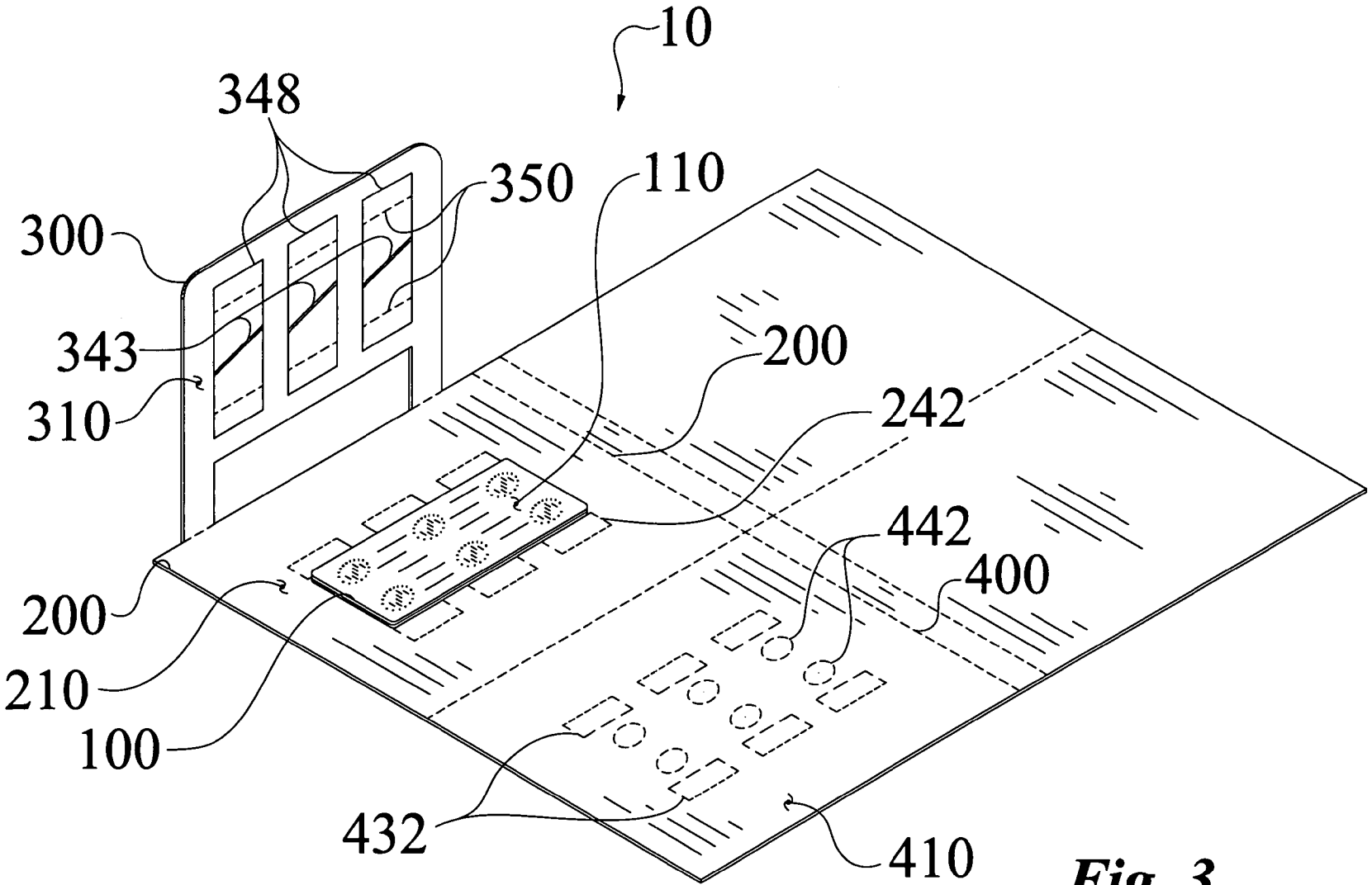
FIG. 3 is a perspective view of an embodiment of the child resistant senior friendly medicament storage and distribution package in accordance with the present invention.
Figure 4:
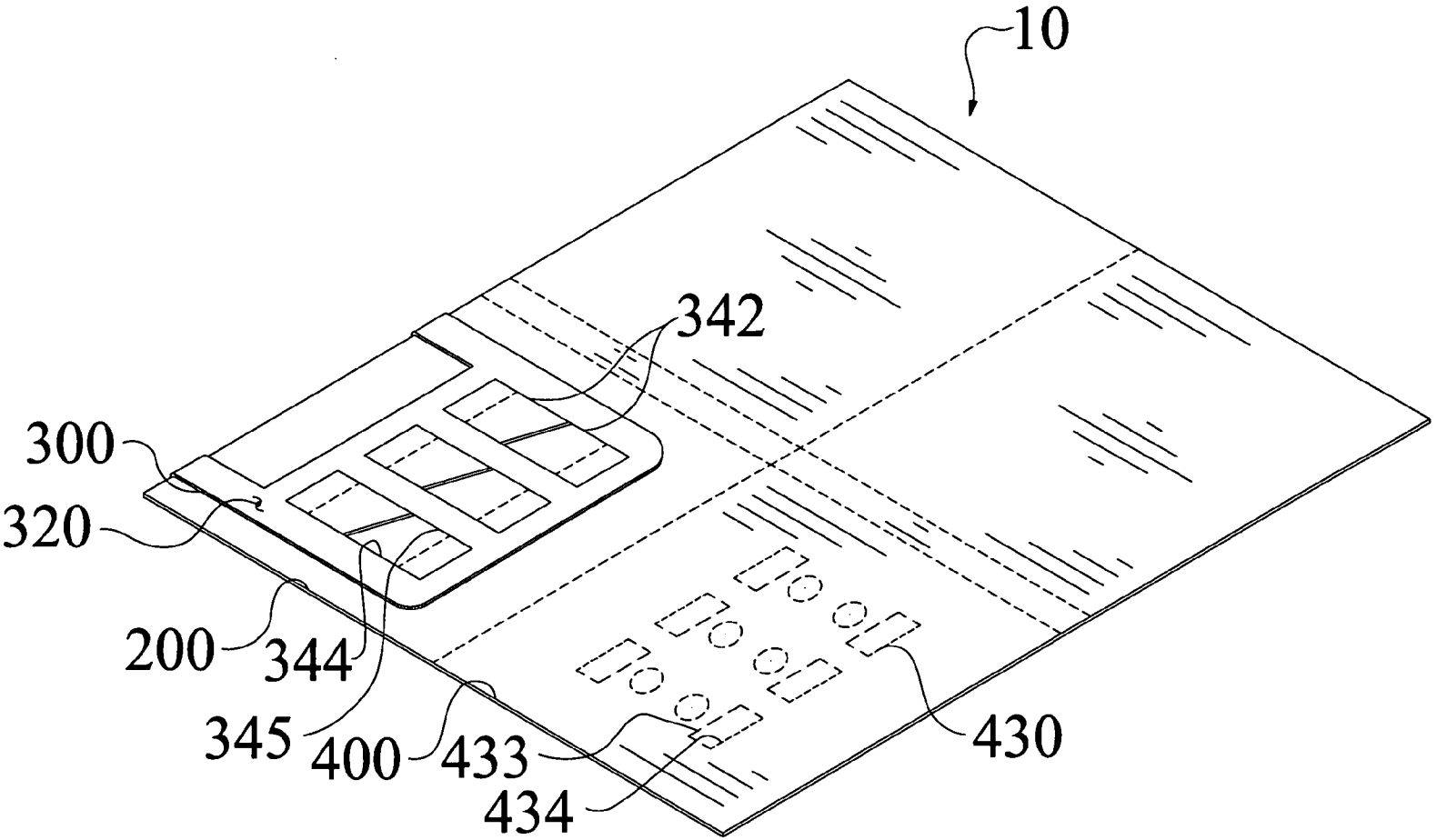
FIG. 4 is a perspective view of an embodiment of the child resistant senior friendly medicament storage and distribution package in accordance with the present invention.
Figure 5:
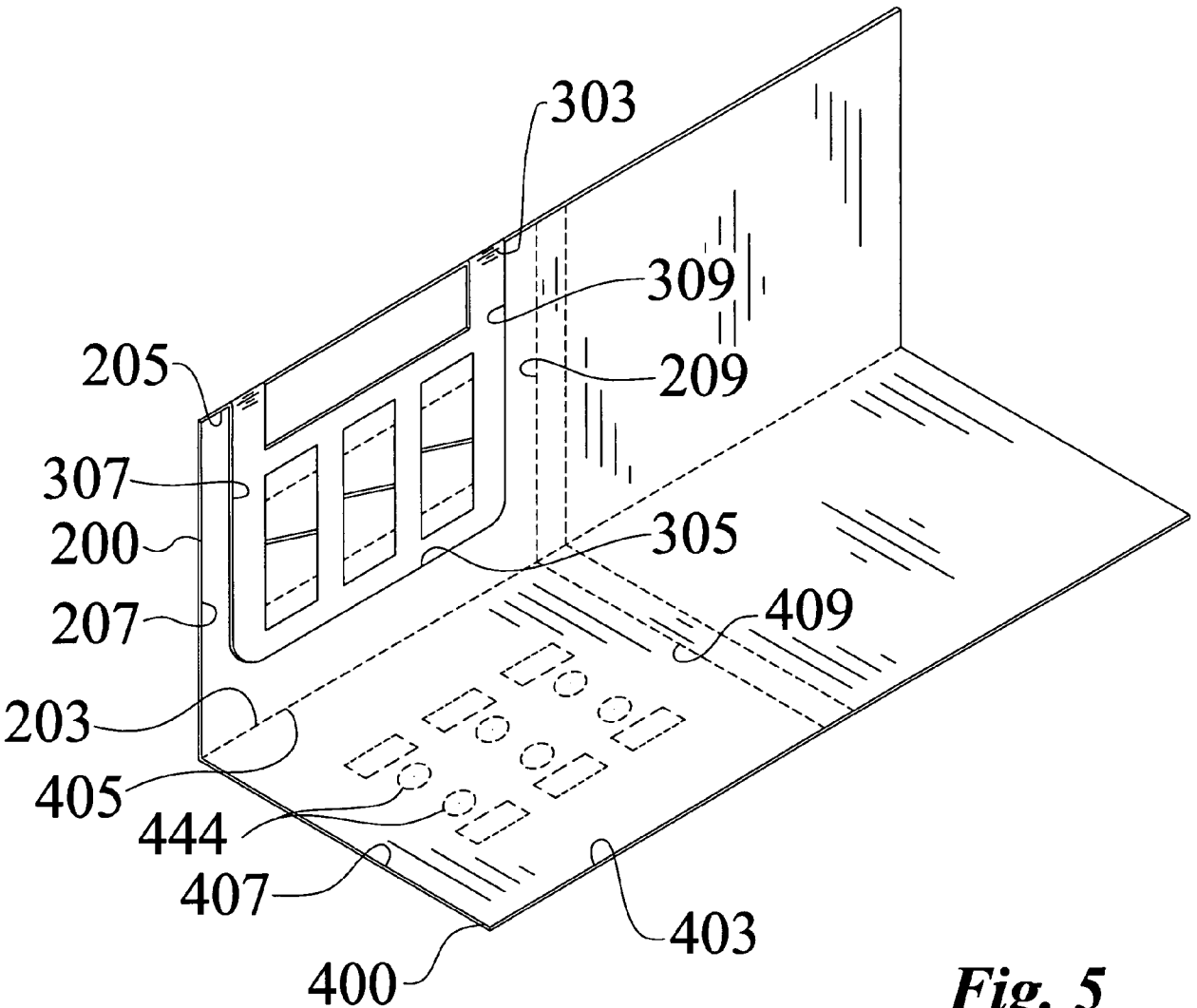
FIG. 5 is a perspective view of an embodiment of the child resistant senior friendly medicament storage and distribution package in accordance with the present invention.
Figure 6:
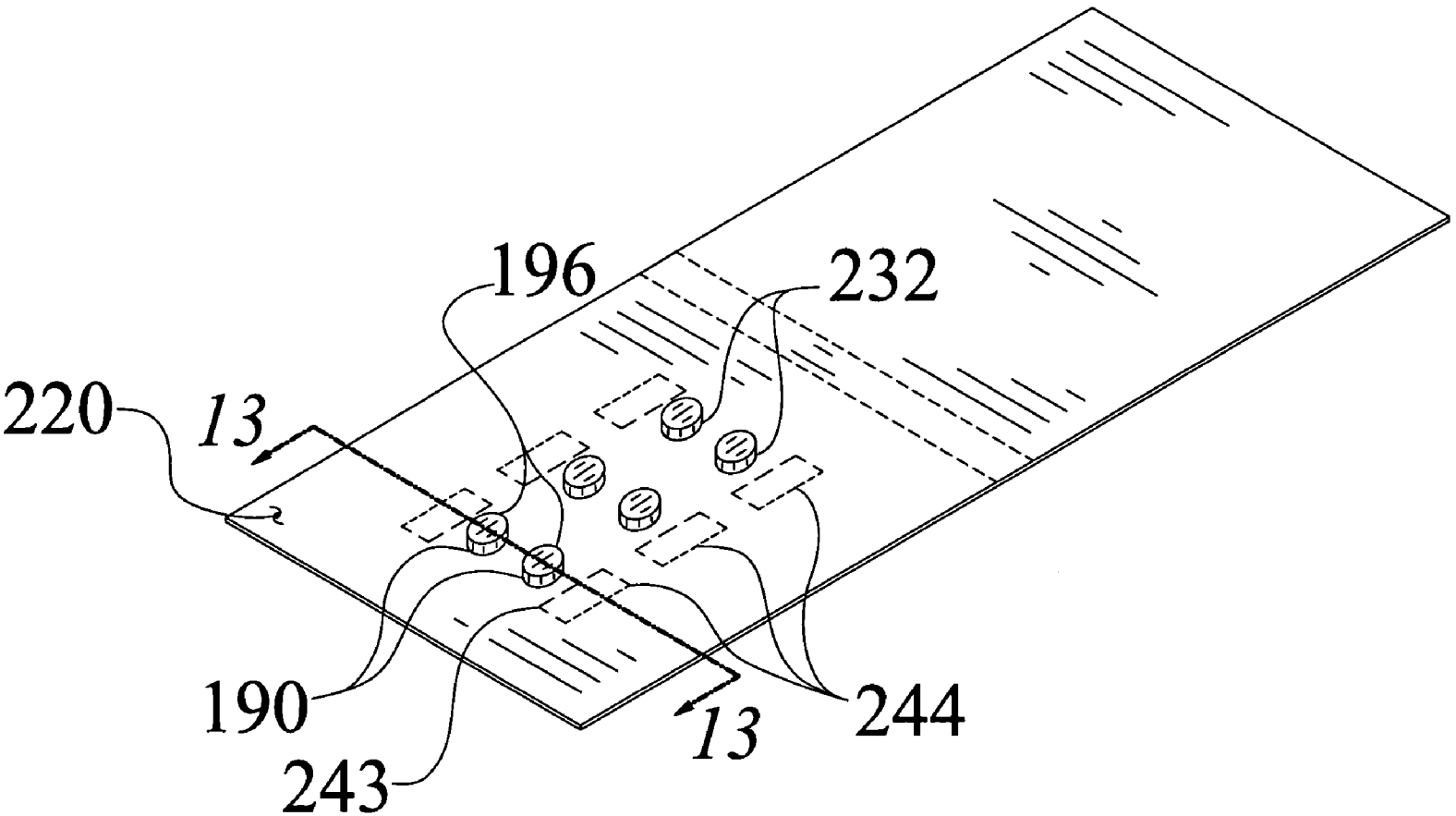
FIG. 6 is a perspective view of an embodiment of the child resistant senior friendly medicament storage and distribution package in accordance with the present invention.

Referring again to FIGS. 1-6, secondly, the dispensing substrate (200) has a dispensing substrate perimeter (201), a dispensing substrate interior surface (210), and a dispensing substrate exterior surface (220). The dispensing substrate (200) is formed to have a dispensing substrate blister receiver (230) and a dispensing substrate initiation region (240). The dispensing substrate blister receiver (230) is configured to cooperate with the blister portion (100) such that a portion of the article receiving blister (190) extends through the dispensing substrate (200) from the dispensing substrate interior surface (210) to the dispensing substrate exterior surface (220). This is illustrated best in FIG. 2 where the blister portion (100) is shown, with the article receiving blisters (190) pointing downward, as it is brought into its installation position wherein the article receiving blisters (190) are lowered into the dispensing substrate blister receivers (230). The remainder of the assembly process is illustrated in FIGS. 3-5, concluding with FIG. 6 illustrating the article receiving blisters (190) projecting through the dispensing substrate blister receivers (230).

The dispensing substrate initiation region (240) will be discussed in greater detail later, however, for now initiation region (240) need only be thought of as an area that may be used to transfer a force to the blocking substrate (300) or as an area that a portion of the blocking substrate (300) may pass through. The dispensing substrate initiation region (240) may (a) simply be a void formed in the dispensing substrate (200) thereby allowing access to the blocking substrate (300), (b) a flap that rotates away from the dispensing substrate exterior surface (220), (c) a flap similar to that of (b) but including a means for attaching the flap to the dispensing substrate (200) until a predetermined force is exerted that causes the flap to break-away from the dispensing substrate (200), or (d) a punch-out region that is attached to the dispensing substrate (200), shielding the blocking substrate (300), until acted upon by a predetermined force that punches-out the region (240).

Thirdly, the blocking substrate (300) has a blocking substrate perimeter (301), a blocking substrate interior front surface (310), and a blocking substrate rear surface (320). As seen in FIG. 3, the blocking substrate (300) includes a gate (340) having a gate perimeter (342) including a gate free edge (343) and a gate retaining edge (348). The gate (340) is generally rectangular in shape with three of the sides being free from the surrounding blocking substrate (300), and the forth side, referred to as the gate retaining edge (348) being connected to, or integral with, the surrounding blocking substrate (300). In addition to the gate free edge (343), the other two free sides include the sinistral edge (344) and the dextral edge (345), shown in FIG. 4. The gate (340) is positioned such that initially a portion of the gate (340) covers, or blocks, the article receiving blister (190). As such, the gate (340) must be moved, or slid, out of the way in order to eject the medicament (M) from the article receiving blister (190). The functioning of the gate (340) will be described later in greater detail.

The blocking substrate (300) may be a unitary piece of material or it may be formed from the same piece of material as the dispensing substrate (200), as seen in FIGS. 1-5. In one particular embodiment, the blocking substrate (300) is comprised of a material and thickness that cannot be readily torn, ruptured, or otherwise compromised by a human finger pushing on the medicament (M) in the article receiving blister (190). The material may be paper, or other fiber product, plastic, foil, or composite.

Figure 8:
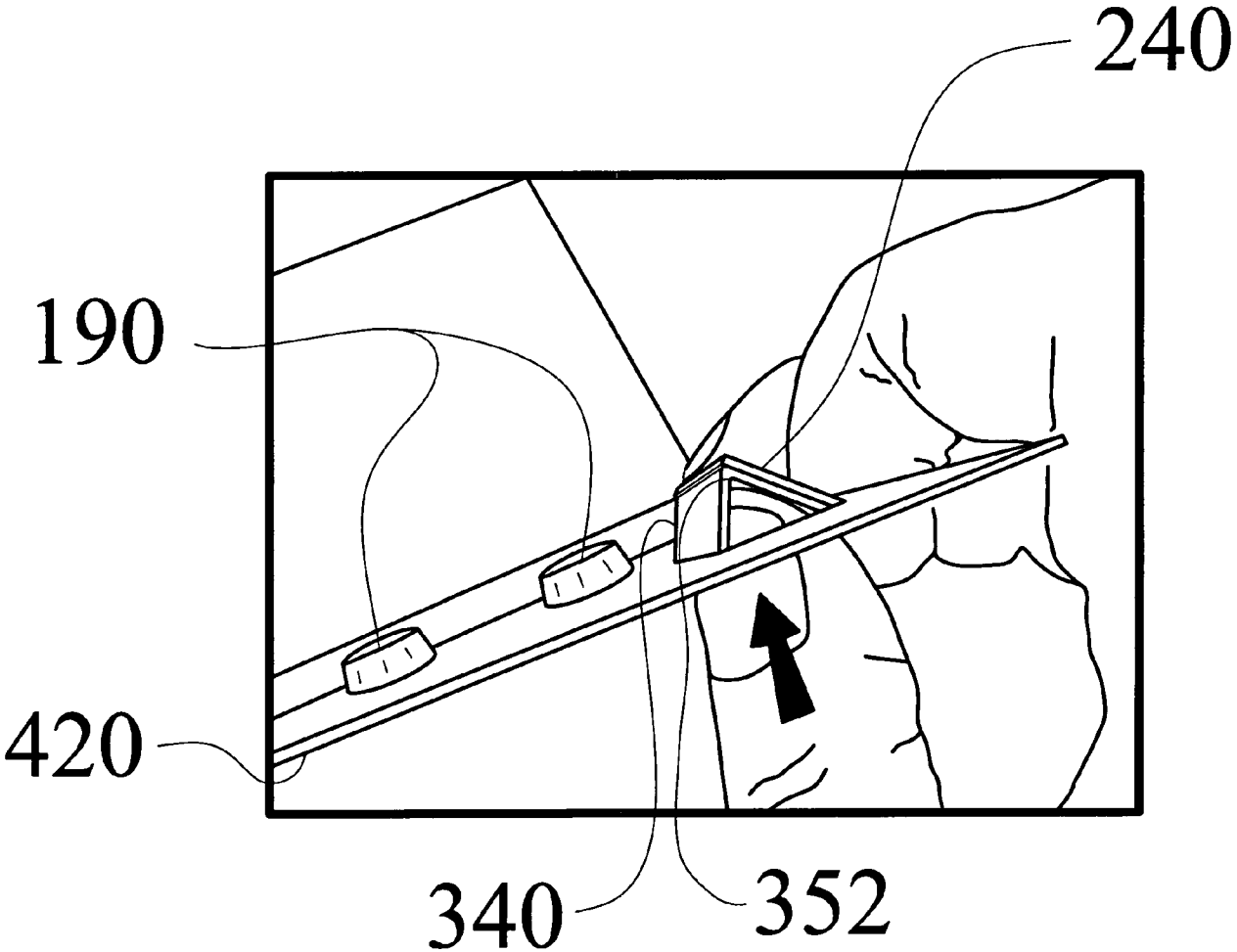
FIG. 8 is a perspective view of an embodiment of the child resistant senior friendly medicament storage and distribution package in accordance with the present invention.

Fourth, with continued reference to FIGS. 1-6, the package (10) includes a backing substrate (400) having a backing substrate perimeter (401), a backing substrate interior surface (410), and a backing substrate exterior surface (420), labeled in FIG. 8 only. The backing substrate (400) is formed to have a backing substrate initiation region (430) and an article dispensing region (440). The backing substrate initiation region (430) may be identical to the dispensing substrate initiation region (240), previously discussed. As with the dispensing substrate initiation region (240), the backing substrate initiation region will be discussed in greater detail later herein, and for now need only be thought of as an area that may be used to transfer a force to the blocking substrate (300) or as an area that a portion of the blocking substrate (300) may pass through. The backing substrate initiation region (430) may (a) simply be a void formed in the backing substrate (400) thereby allowing access to the blocking substrate (300), (b) a flap that rotates away from the backing substrate exterior surface (420), (c) a flap similar to that of (b) but including a means for attaching the flap to the backing substrate (400) until a predetermined force is exerted that causes the flap to break-away from the backing substrate (400), or (d) a punch-out region that is attached to the backing substrate (400), shielding the blocking substrate, until acted upon by a predetermined force that punches-out the region (430).

The article dispensing region (440) has an article dispensing region perimeter (442) and is configured to cooperate with the blister portion (100), as seen in FIG. 3. In other words, the article receiving blister (190) and the article dispensing region (440) must generally align such that when the medicament (M) is ejected from the article receiving blister (190), and the gate (340) is out of the way, the medicament (M) may pass through the article dispensing region (440). In one embodiment, seen in FIGS. 18 and 19, the backing substrate article dispensing region (440) defines a void formed in the backing substrate (400) sized to cooperate with the medicament (M) so that the medicament (M) may pass through the article dispensing region (440) for distribution.

Alternatively, the backing substrate article dispensing region (440) may be an integral portion of the backing substrate (400) having a separation line (444), seen in FIG. 5, selectively reducing the strength of the backing substrate (400), thereby permitting the medicament (M) to break a portion of the article dispensing region (440) free of the backing substrate (400) along the separation line (444) when the medicament (M) is exposed to the second force, thus permitting the medicament (M) to pass through the article dispensing region (440) for distribution. In a further embodiment, the separation line (444) is located substantially on the article dispensing region perimeter (442). The separation line (444) need not be one continuous separation line (444) and may include one or more die cuts, perforations, indentations, score lines, and weakened fracture lines. As with the blocking substrate (300), in one particular embodiment the backing substrate (400) is comprised of a material and thickness that cannot be readily torn, ruptured, or otherwise compromised by a human finger pushing on the medicament (M) in the article receiving blister (190). The material may be paper, or other fiber product, plastic, foil, or composite.

The assembly and orientation of the various elements of the package (10) imparts the desired functionality to achieve the predetermined sequence of operation necessary to open the package (10). The general assembly process is illustrated in FIGS. 1-6. Although the figures illustrate the dispensing substrate (200), the blocking substrate (300), and the backing substrate (400) as being formed from a single continuous substrate that is folded multiple times, one with skill in the art will appreciate that each of these components may be separate and distinct elements that are joined together to create the package (10). However, the continuous substrate embodiment illustrated in the figures is preferred for its high-speed formation and assembly characteristics. Such characteristics include having predetermined fold locations between the various substrates (200, 300, 400) so that the gate (340), the article dispensing region (440), and the initiation regions (240, 430) are consistently and precisely placed in relation with one another to cooperate to achieve the desired sequence of operation.

The blister portion (100) is located between the dispensing substrate (200) and the blocking substrate (300). In fact, the blister portion blister layer (150) is adjacent to the dispensing substrate interior surface (210) and the blocking substrate front surface (310) is adjacent to the blister portion base layer (110). As seen in FIG. 2, the blister portion (100) is brought into proximity to the dispensing substrate (200) and placed so that the article receiving blisters (190) mate with the dispensing substrate blister receivers (230).

Once the blister portion (100) is in place, the blocking substrate (300) is brought into contact with the blister portion (100). In the embodiment of FIGS. 3 and 4, the blocking substrate (300) is merely rotated into the correct position against the blister portion (100). As seen in FIG. 4, each gate (340) covers a portion of the base layer (110) that is closing an article receiving blister (190). The gate (340) is initially located between the article dispensing region (440) and the article receiving blister (190) to prevent unintentional dispensing of the medicament (M). Additionally, the width of the gate (340) is less than the width of the dispensing substrate initiation region (240) so that a portion of the gate (340) may be fed through the initiation region (240), as will be discussed later.

Then, with the blocking substrate (300) in place, the backing substrate (400) is brought into position to essentially close the package (10). In the embodiment of FIGS. 1-6, this positioning merely involved folding the backing substrate (400) to cover the blocking substrate (300) and the blister portion (100). As seen in the figures, the dispensing substrate perimeter (201) and the backing substrate perimeter (401) will generally be identical with the dispensing substrate initiation regions (240) substantially symmetrical to the backing substrate initiation region (430) and the dispensing substrate blister receivers (230) substantially symmetrical to the article dispensing regions (440). The various elements may be individually joined together via adhesive or other material joining technique; however, in the embodiment of FIGS. 1-6 the dispensing substrate (200) is generally only joined to the backing substrate (400). In this embodiment, the blister portion (100) is held in place by the dispensing substrate blister receivers (230) and the action of the backing substrate (400) ensuring that the article receiving blisters (190) remain in the dispensing substrate blister receivers (230). Further, in this embodiment the blocking substrate (300) is held in position by virtue of its connection to the dispensing substrate (200). The child resistance is further increased by the fact that the previously disclosed method of joining the backing substrate (400) to the dispensing substrate (200) ensures that peeling, or separation, of the substrates (200, 400) from one another by human fingers is extremely difficult, if not impossible. In one embodiment of assembly, the blister is sealed between parts (300) and (200). The area (310) seals to the blister unit base layer (lidding top) and also to (210). The initiation region on (200) is also sealed to the gate between the area from (348) to (350). Next (400) is sealed to (320) and (210). The initiation region on (400) is also sealed to the gate between the area from (348) to (350) on the opposite side of (300). With this assembly, the gate becomes attached to the two initiation regions and the blister unit becomes well protected from access from the outer edges of the package.

The user could also remove or tear out the gate (340) instead of holding it flat after being hinged. The gate retaining edge (348) can be perforated so that it can be torn out from the package along with the two initiation regions (240, 430).

It should be noted that although the figures of the present application illustrate package (10) embodiments having six article receiving blisters (190), and therefore six gates (340), six article dispensing regions (440), six dispensing substrate initiation regions (240), and six backing substrate initiation regions (430), the present invention need only incorporate one of each of the previously listed elements, yet may incorporate hundreds of such elements.

Now, to dispense the medicament (M) from the package (10) requires application of a first force to a portion of the gate (340) resulting in the gate free edge (343) sliding toward the gate retaining edge (348) and past the article dispensing region (440), as seen in FIGS. 7, 8, 13, and 16. Generally, the first force will be applied by a tip of a human digit, most likely the thumb. The first force may be applied from the backing substrate (400) side of the package (10), as seen in FIG. 8, or may alternatively be applied from the dispensing substrate (200) side of the package (10). The first force must only be significant enough to displace a portion of the gate (340) through either the dispensing substrate initiation region (240) or the backing substrate initiation region (430), when the regions (240, 430) are merely voids in the substrates (200, 400), causing the desired movement of the gate free edge (343). However, if as previously disclosed, either, or both, regions (240, 430) include a flap that may, or may not, be attached to the surrounding substrate (200, 400) then the first force must be greater in magnitude to displace, or break-free, the flap.

Figure 9:
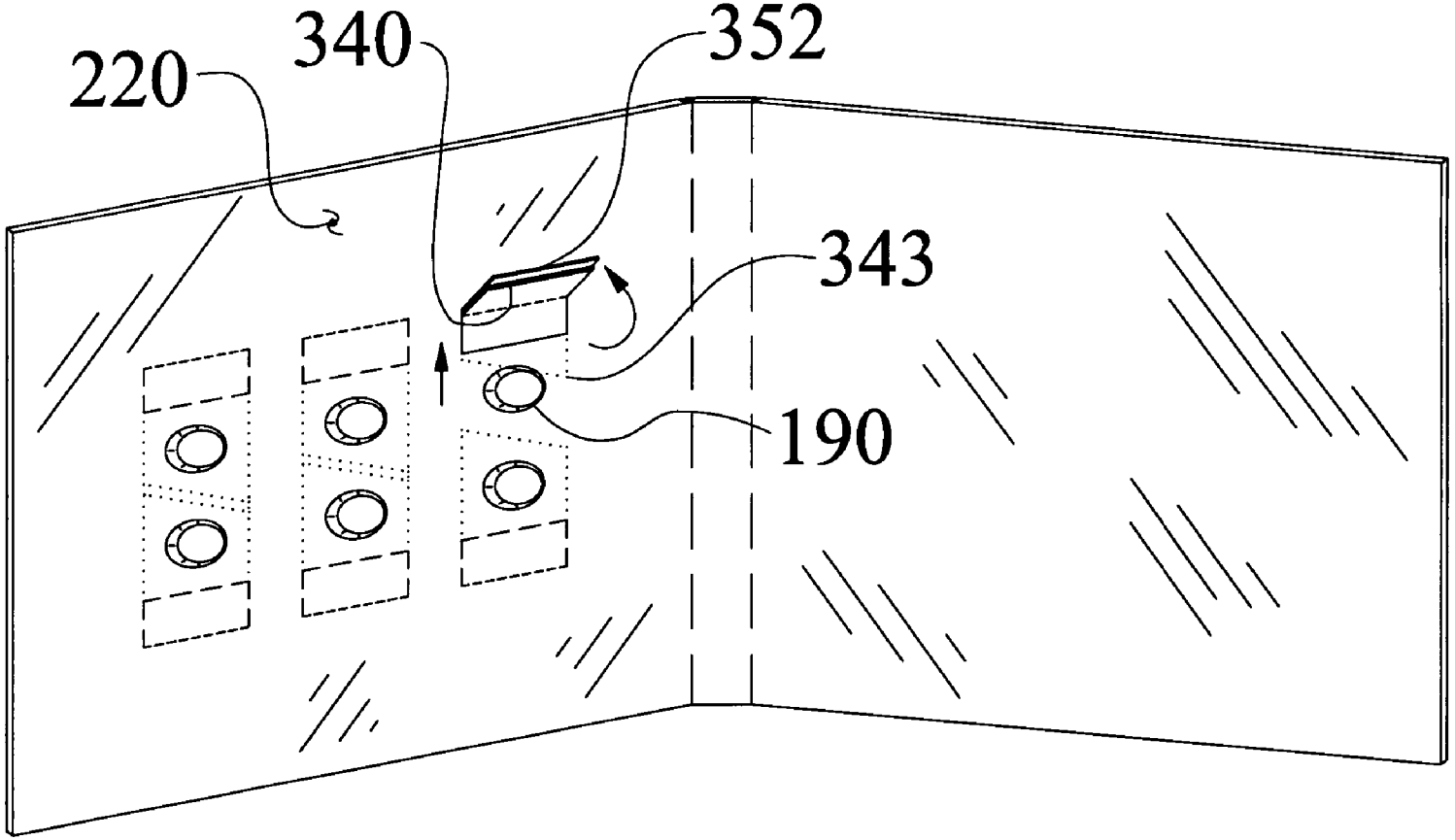
FIG. 9 is a perspective view of an embodiment of the child resistant senior friendly medicament storage and distribution package in accordance with the present invention.
Figure 10:
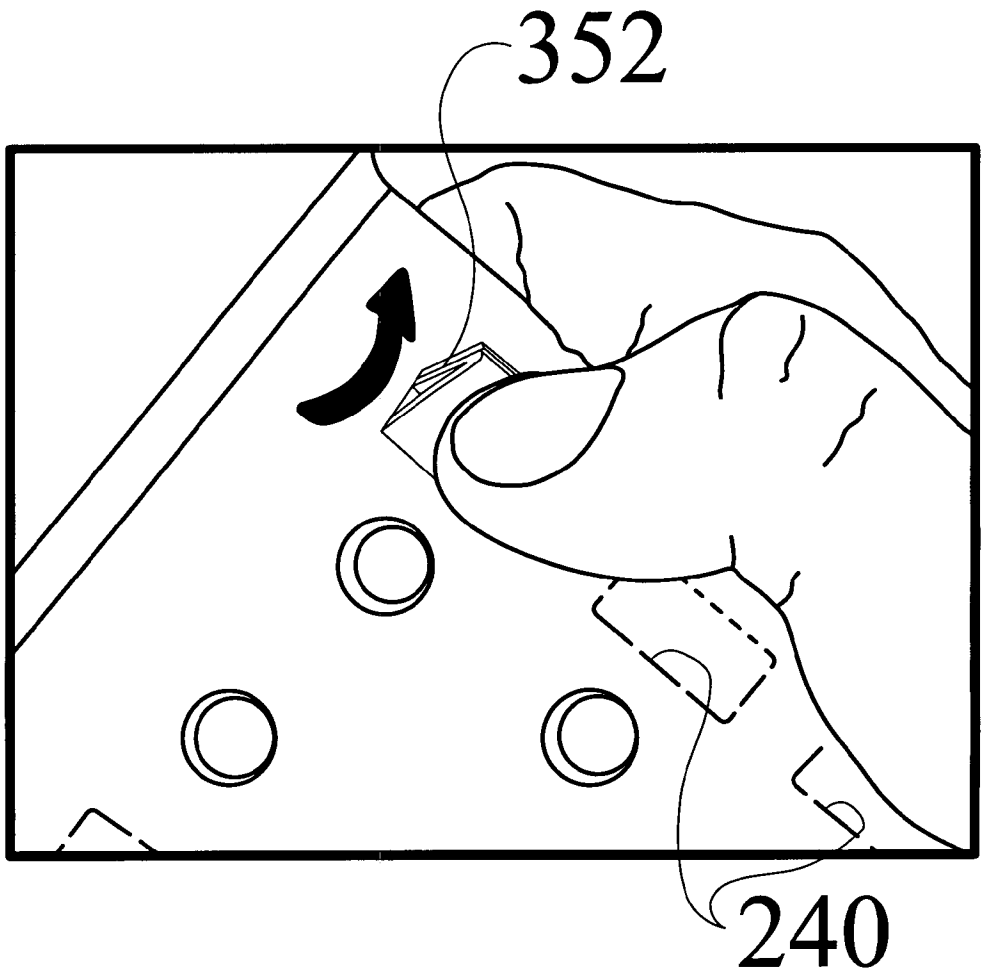
FIG. 10 is a perspective view of an embodiment of the child resistant senior friendly medicament storage and distribution package in accordance with the present invention.
Figure 11:
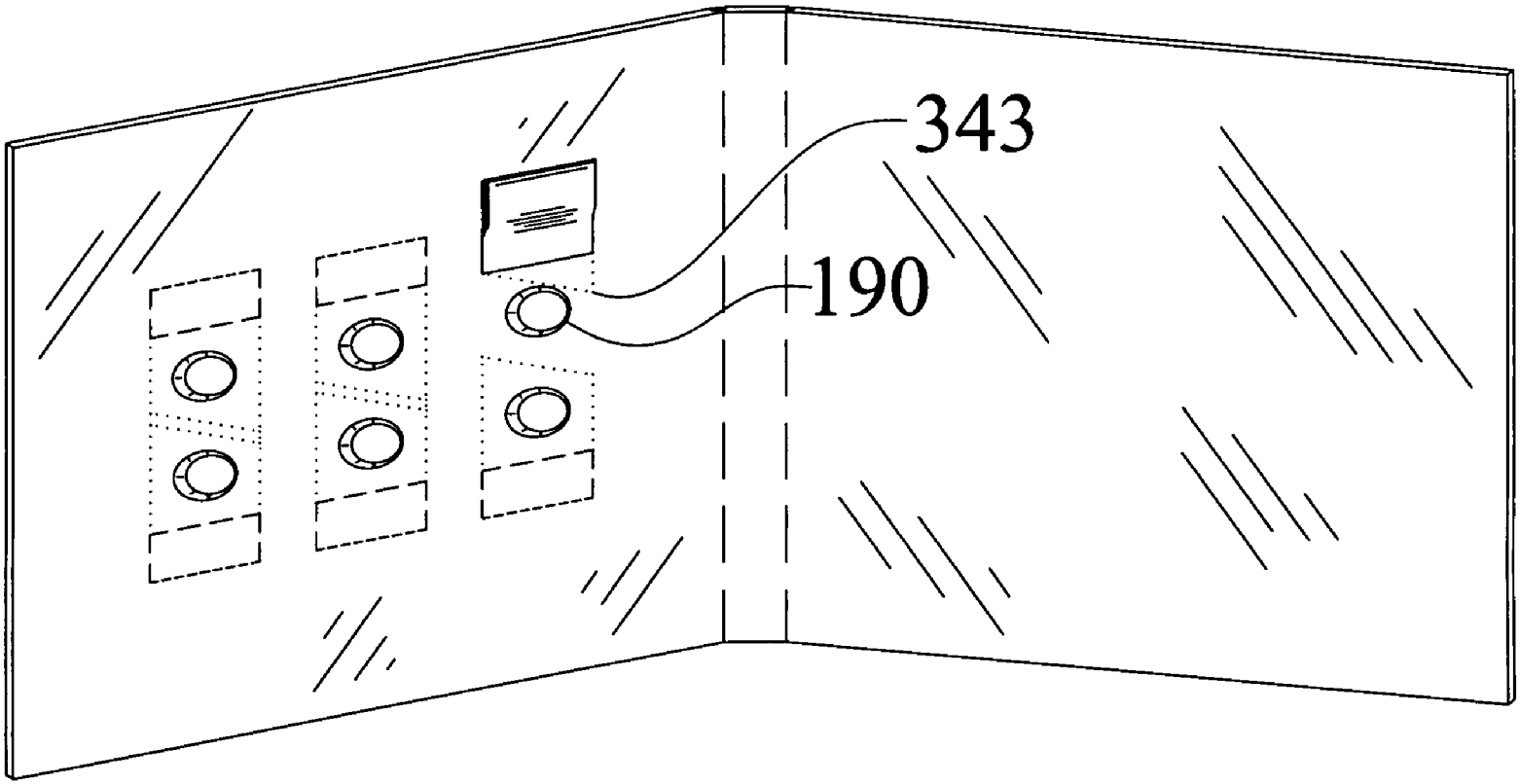
FIG. 11 is a perspective view of an embodiment of the child resistant senior friendly medicament storage and distribution package in accordance with the present invention.
Figure 15:
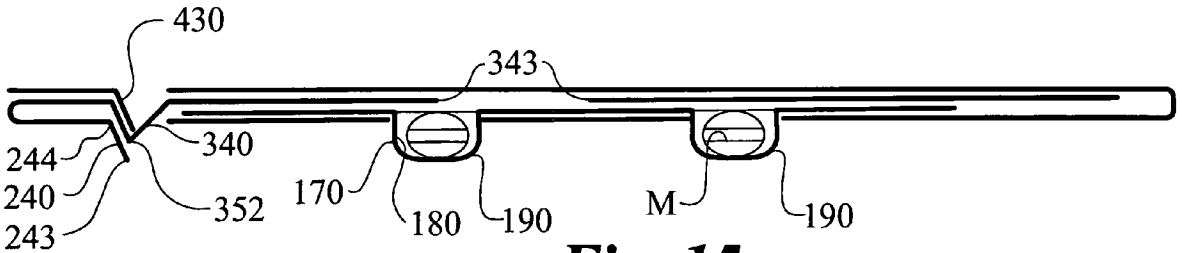
FIG. 15 is a cross sectional view of an embodiment of the child resistant senior friendly medicament storage and distribution package of FIG. 13 illustrating the sequence of operation, in accordance with the present invention.
Figure 16:
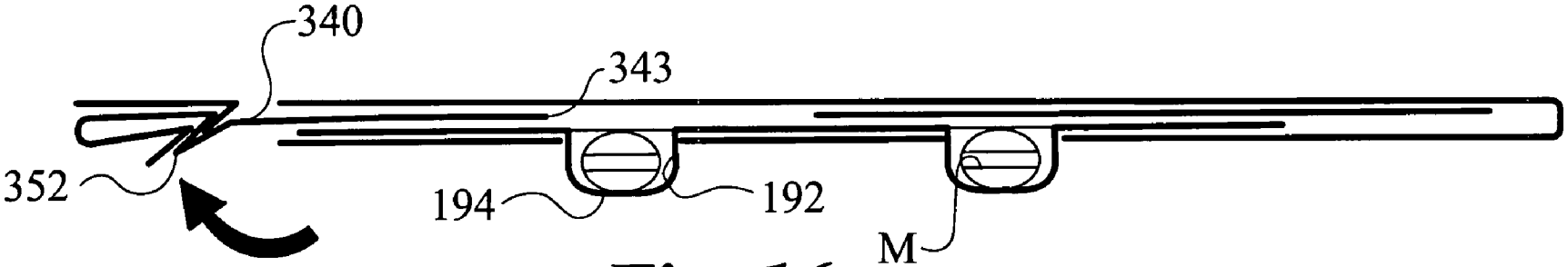
FIG. 16 is a cross sectional view of an embodiment of the child resistant senior friendly medicament storage and distribution package of FIG. 13 illustrating the sequence of operation, in accordance with the present invention.

The initiation regions (240, 430) and the gate (340) may be designed such that a user simply keeps displacing a portion of the gate (340) away from the package until the gate free edge (343) moves the requisite distance so as not to block the path of the medicament (M), or the gate (340) may incorporate a fold promoting characteristic (350) that minimizes the distance that the gate (340) must be forced orthogonally away from the package (10). In fact, the fold promoting characteristic (350) is generally a feature applied to the gate (340) that causes it to fold in a predetermined location and fashion as the first force is applied. In particular, as seen in FIGS. 8 and 15, one embodiment of the fold promoting characteristic (350) causes the gate (340) to fold as soon as it is displaced out of the plane of the package (10). This folding action creates a pivot projection (352) that a user may then pivot away from the associated article receiving blister (190), thereby resulting in the desired movement of the gate free edge (343), as seen in FIGS. 9, 10, and 16. This embodiment is particular effective because it is easy for an adult to apply the first force that displaces the gate (340) and creates the pivot projection (352) that is then simply pivoted by pushing the projection toward the package (10), thus not requiring fine motor skills.

Figure 12:
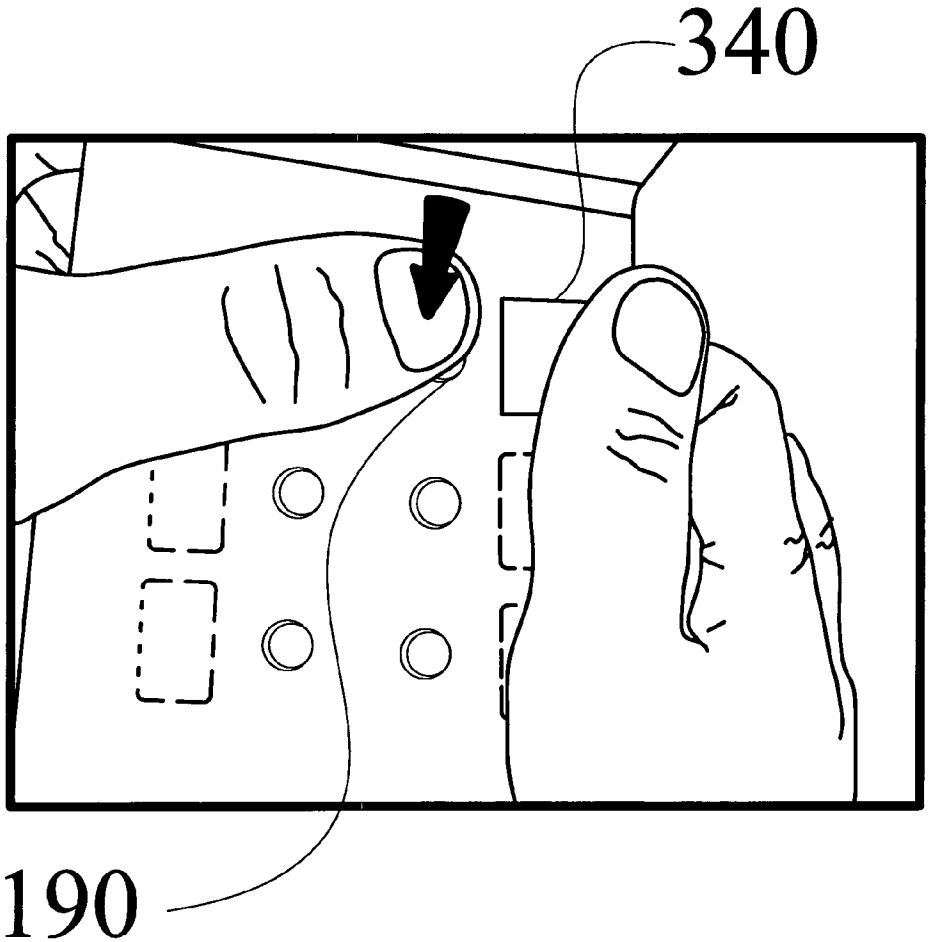
FIG. 12 is a perspective view of an embodiment of the child resistant senior friendly medicament storage and distribution package in accordance with the present invention.
Figure 17:
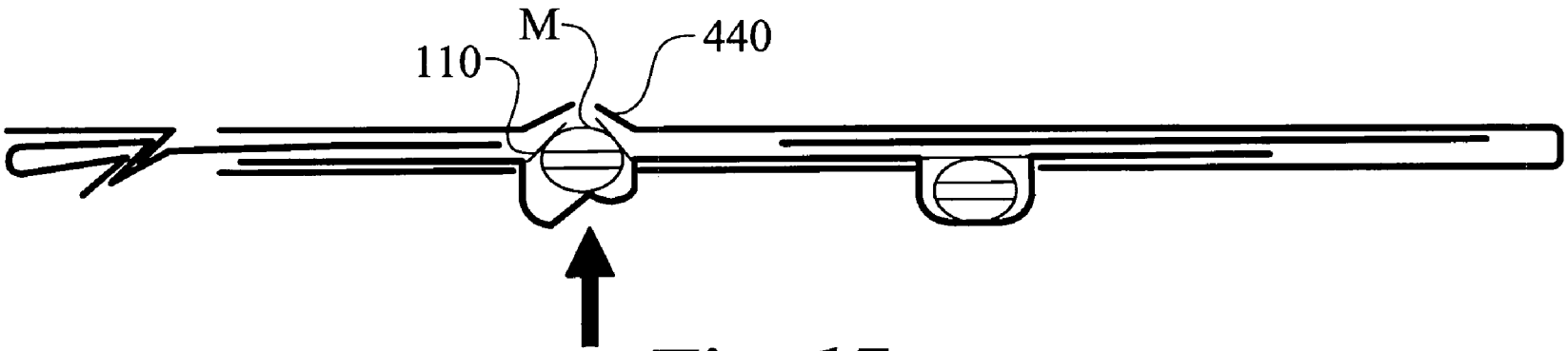
FIG. 17 is a cross sectional view of an embodiment of the child resistant senior friendly medicament storage and distribution package of FIG. 13 illustrating the sequence of operation, in accordance with the present invention.

Now, with the gate (340) no longer blocking the path of the medicament (M) from the article receiving blister (190) to the article dispensing region (440), application of a second force to the article receiving blister (190) forces the medicament (M) to break through the base layer (110), pass through an opening in the blocking substrate (300) created by the movement of the gate (340), and out the article dispensing region (440), as seen in FIGS. 12, 16, and 17.

Figure 13:
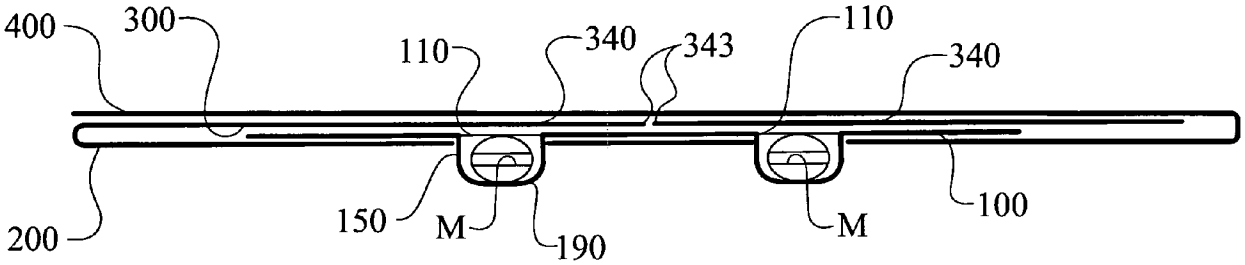
FIG. 13 is a cross sectional view of an embodiment of the child resistant senior friendly medicament storage and distribution package taken alone section line 13-13 in FIG. 6, in accordance with the present invention.

The fold promoting characteristic (350) is best seen in FIGS. 3 and 13. The fold promoting characteristic (350) need not be one continuous line and may include one or more die cuts, perforations, indentations, score lines, and weakened fracture lines. The fold promoting characteristic (350) is generally aligned on the gate (340) so that it lies substantially in-line with the portion of the dispensing substrate initiation region breakage edge (243) farthest from the dispensing substrate initiation region retaining edge (244), and lies substantially in-line with the portion of the backing substrate initiation region breakage edge (433) farthest from the backing substrate initiation region retaining edge (434), as seen in FIGS. 13 and 14.

Figure 14:
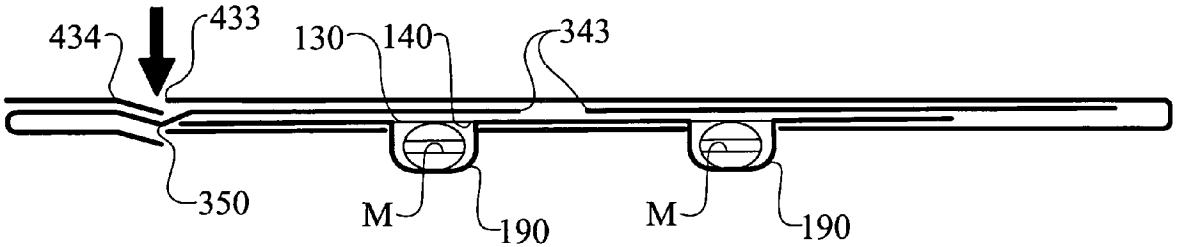
FIG. 14 is a cross sectional view of an embodiment of the child resistant senior friendly medicament storage and distribution package of FIG. 13 illustrating the sequence of operation, in accordance with the present invention.

The important attributes afforded to the package (10) by the gate (340) are best illustrated in FIGS. 13-17. First, FIG. 13 illustrates a cross sectional view of the package (10) prior to any manipulation by the user. Secondly, FIG. 14 illustrates the breakage of the dispensing substrate initiation region (240) away from the dispensing substrate (200) and the backing substrate initiation region (430) away from the backing substrate (400), as well as the initial displacement of the gate (430) and fold formation along the fold promoting characteristic (350). Next, FIG. 15 illustrates further movement of the blocking substrate gate free edge (343) such that it is only partially blocking the medicament (M). In this particular embodiment the position of the blocking substrate gate free edge (343) remains blocking the medicament (M) even after the first force has displaced the gate (340) orthogonally from the package (10) as much as possible. Therefore, the user must then rotate, or pivot, the gate (340) and initiation regions (240, 430), when present, as seen in FIG. 16 to completely draw the gate free edge (343) past the medicament (M), and therefore the article dispensing region (440), so that application of the second force on the article receiving blister (190) causes the medicament (M) to break free of the base layer (110) and to exit, or break free of, the article dispensing region (440), as seen in FIG. 17.

Figure 18:
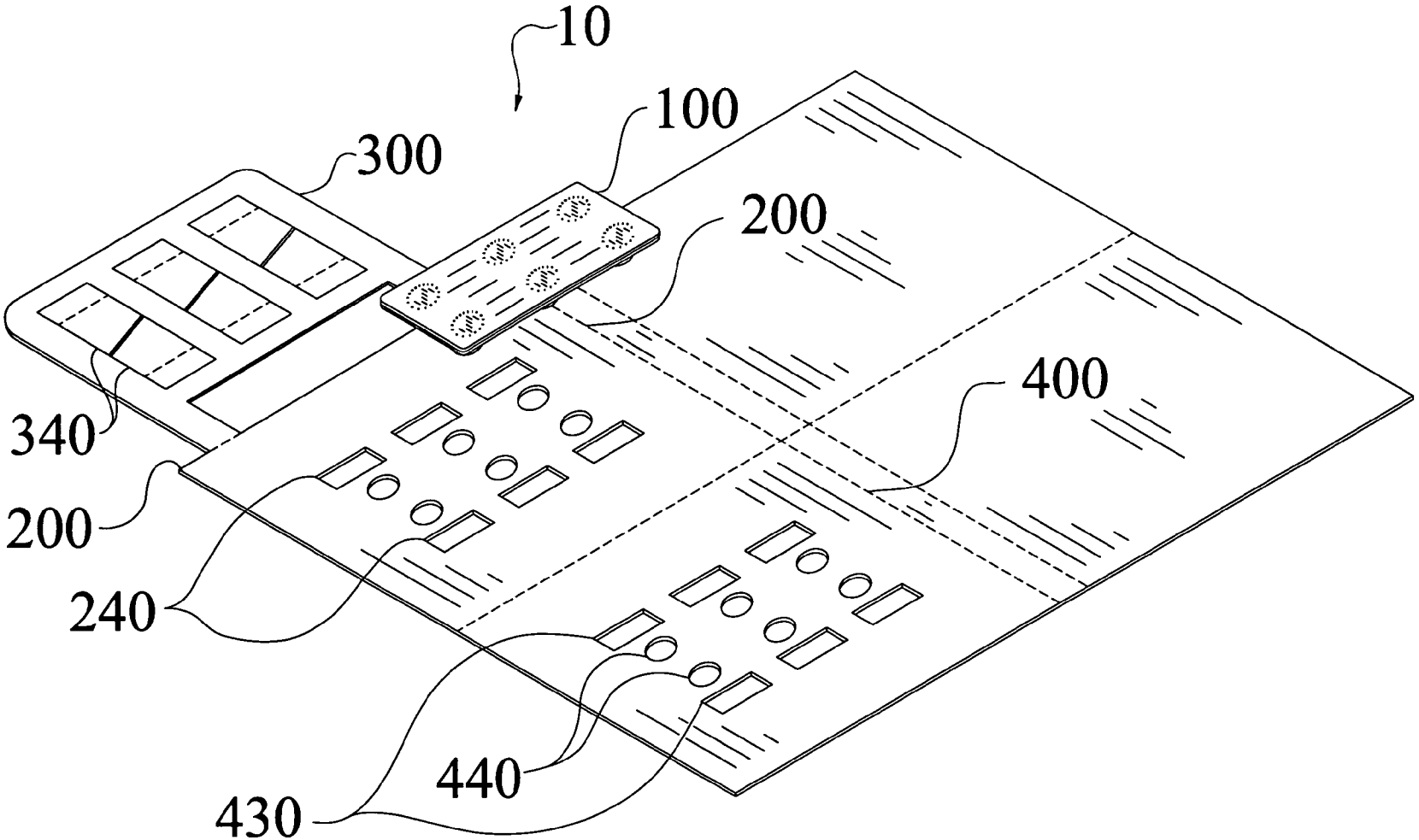
FIG. 18 is a perspective view of an embodiment of the child resistant senior friendly medicament storage and distribution package in accordance with the present invention.
Figure 19:
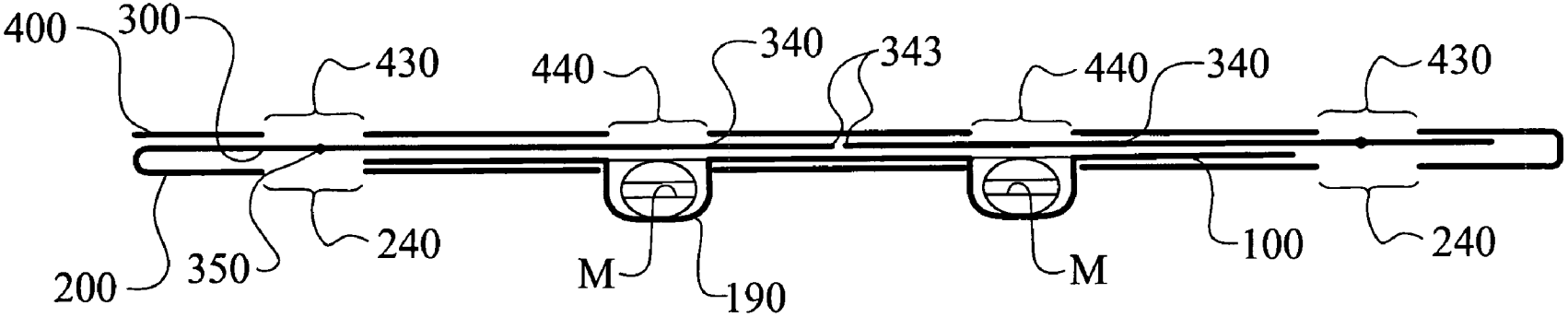
FIG. 19 is a cross sectional view of an embodiment of the child resistant senior friendly medicament storage and distribution package of FIG. 13 illustrating the sequence of operation, in accordance with the present invention.

As previously discussed, the dispensing substrate initiation region (240) may simply define a void formed in the dispensing substrate (200), as seen in FIGS. 18 and 19, sized to cooperate with the gate (340) and the average size tip of a human finger such that application of the first force by a human finger results in a portion of the gate (340) extending through the dispensing substrate initiation region (240). Similarly, the backing substrate initiation region (430) may simply define a void formed in the backing substrate (400) sized to cooperate with the gate (340) and the average size tip of a human finger such that application of the first force by a human finger results in a portion of the gate (340) extending through the backing substrate initiation region (430). However, in such embodiments the gate (340) is more apt to be accidentally moved than embodiments that incorporate covers that initially shield the gate (340) from access. In yet another preferred embodiment, the dispensing substrate initiation region (240) and the backing substrate initiation region (430) are between approximately 0.12 square inches and approximately 0.5 square inches to correspond the a wide range of human fingertip sizes.

Figure 7:
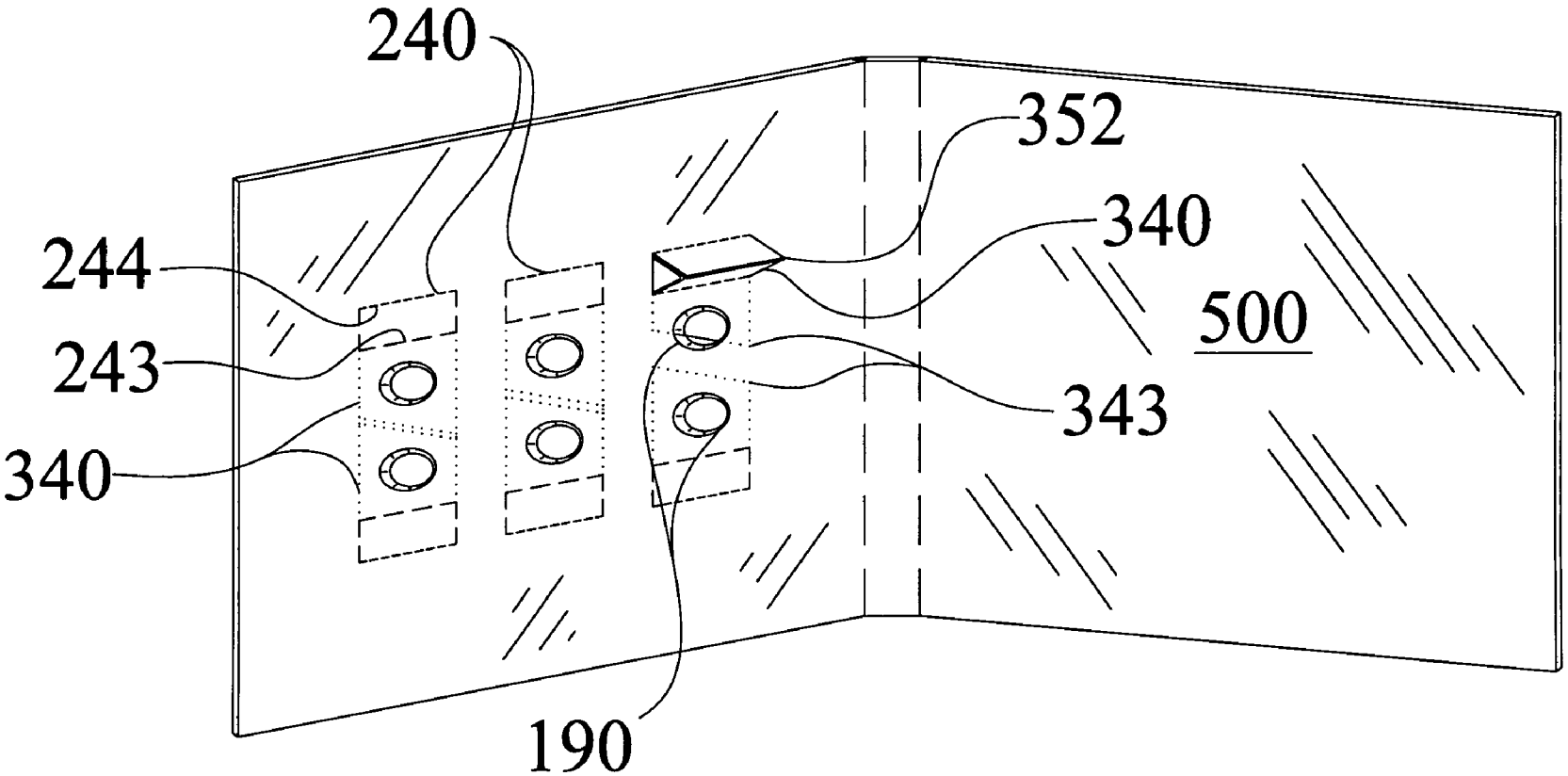
FIG. 7 is a perspective view of an embodiment of the child resistant senior friendly medicament storage and distribution package in accordance with the present invention.

In alternative embodiments seen in FIGS. 1-17, the initiation regions (240, 430) are integral to the surrounding substrate (200, 400), thereby shielding the gate (340) from unintentional contact and increasing the child resistance of the package (10). In such embodiments, the first force is transferred to the gate (340) through the initiation regions (240, 430). In this embodiment, seen in FIG. 7, the dispensing substrate initiation region (240) has a dispensing substrate initiation region retaining edge (244) that connects the initiation region (240) to the surrounding dispensing substrate (200), and serves as a line about which the initiation region (240) rotates upon application of the first force. Similarly, as seen in FIGS. 4, 14, and 15, the backing substrate initiation region (430) has a backing substrate initiation region retaining edge (434) that connects the initiation region (430) to the surrounding backing substrate (400), and serves as a line about which the initiation region (430) rotates upon application of the first force. In still further embodiments, the child resistance is even more improved by ensuring that the entire perimeters (242, 432) of the regions (240, 430) are at least intermittently attached to the adjacent substrate (240, 430). In such embodiments, the perimeters (242, 432) include not only the retaining edges (244, 434), but also breakaway edges (243, 433), as seen in FIGS. 4 and 7, that selectively reduce the strength of the corresponding substrate (200, 400). The breakaway edges (243, 433) increase the magnitude of the first force that is required to displace the gate (340) because the corresponding regions (240, 430) must first be broken free of the adjacent substrate (200, 400) along the breakaway edges (243, 433). The breakaway edges (243, 433) need not be one continuous line and may include one or more die cuts, perforations, indentations, score lines, weakened fracture lines, and the like. As with the blocking substrate (300) and the backing substrate (400), in one particular embodiment the dispensing substrate (200) is comprised of a material and thickness that cannot be readily torn, ruptured, or otherwise compromised by a human finger. The material may be paper, or other fiber product, plastic, foil, or composite. The package (10) of the present invention may further include a cover substrate (500), seen in FIG. 7, for protection of the article receiving blister (190).

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

INDUSTRIAL APPLICABILITY

The child resistant medicament storage and distribution package answers a long felt need for a novel package that is both child resistant and senior-friendly. The package is for use with small or large medicaments of various shapes. The present invention discloses a package that implements requiring the performance of multiple steps before the medicament can be dispensed, thereby avoiding some of the inherent problems of medication packages that use peeling to be opened. The package of the present invention is relatively easy for an adult to manipulate, but not easy for a child to access the package.

We claim:

1. A medicament storage and distribution package (10) for housing a medicament (M), comprising:

(a) a blister portion (100) having:

(i) a base layer (110) having a base layer perimeter (120), a base layer exterior surface (130), and a base layer interior surface (140);

(ii) a blister layer (150) having a blister layer perimeter (160), a blister layer exterior surface (170), a blister layer interior surface (180), and including an article receiving blister (190), having a blister perimeter (196), formed therein, wherein the article receiving blister (190) is designed for holding the medicament (M); wherein (iii) at least five percent of the surface area of the base layer interior surface (130) is joined to the blister layer interior surface (180) thereby sealing the medicament (M) in the article receiving blister (190);

(b) a dispensing substrate (200) having a dispensing substrate perimeter (201), a dispensing substrate interior surface (210), and a dispensing substrate exterior surface (220), wherein the dispensing substrate (200) is formed to have:

(i) a dispensing substrate blister receiver (230) configured to cooperate with the blister portion (100) such that a portion of the article receiving blister (190) extends through the dispensing substrate (200) from the dispensing substrate interior surface (210) to the dispensing substrate exterior surface (220); and (ii) a dispensing substrate initiation region (240);

(c) a blocking substrate (300) having a blocking substrate perimeter (301), a blocking substrate front surface (310), and a blocking substrate rear surface (320), wherein the blocking substrate (300) includes a gate (340) having a gate perimeter (342) including a gate free edge (343) and a gate retaining edge (348);

(d) a backing substrate (400) having a backing substrate perimeter (401), a backing substrate interior surface (410), and a backing substrate exterior surface (420), wherein the backing substrate (400) is formed to have:

(i) a backing substrate initiation region (430); and (ii) an article dispensing region (440) having an article dispensing region perimeter (442), wherein the article dispensing region (440) is configured to cooperate with the blister portion (100); and (e) wherein the blister portion blister layer (150) is adjacent to the dispensing substrate interior surface (210), the blocking substrate front surface (310) is adjacent to the blister portion base layer (110), and the backing substrate interior surface (410) is adjacent to the blocking substrate rear surface (320) such that the dispensing substrate blister receiver (230), the article receiving blister (190), and the article dispensing region (440) substantially align, and the gate (340) is initially located between the article dispensing region (440) and the article receiving blister (190) to prevent unintentional dispensing of the medicament (M), such that dispensing of the medicament (M) requires application of a first force to a portion of the gate (340) resulting in the gate free edge (343) sliding toward the gate retaining edge (348) and past the article dispensing region (440) such that application of a second force to the article receiving blister (190) forces the medicament (M) to break through the base layer (110), pass through an opening in the blocking substrate (300) created by the movement of the gate (340), and out the article dispensing region (440).

2. The child resistant medicament storage and distribution package (10) of claim 1, wherein the gate (340) has a fold promoting characteristic (350) that causes the gate (340) to begin to fold about the fold promoting characteristic (350) when the gate (340) is displaced out of the plane of the package (10) by the first force, thereby creating a pivot projection (352) that is easily pivoted about the gate retaining edge (348) and away from the article receiving blister (190) drawing the gate free edge (343) past the article receiving blister (190) to permit dispensing of the medicament (M).

3. The child resistant medicament storage and distribution package (10) of claim 1, wherein application of the first force to the portion of the gate (340) results in a portion of the gate (340) extending through the dispensing substrate initiation region (240) resulting in movement of the gate free edge (343) such that the gate (340) does not block access to the article dispensing region (440).

4. The child resistant medicament storage and distribution package (10) of claim 3, wherein the dispensing substrate initiation region (240) defines a void formed in the dispensing substrate (200) sized to cooperate with the gate (340) such that application of the first force results in a portion of the gate (340) extending through the dispensing substrate initiation region (240).

5. The child resistant medicament storage and distribution package (10) of claim 3, wherein the dispensing substrate initiation region (240) is an integral portion of the dispensing substrate (200) and has a dispensing substrate initiation region perimeter (242), a portion that is a dispensing substrate initiation region retaining edge (244) that secures the dispensing substrate initiation region (240) to the dispensing substrate (200) and serves as a line about which the dispensing substrate initiation region (240) may pivot as a portion of the gate (340) is forced through a void in the dispensing substrate (200) previously occupied by the dispensing substrate initiation region (240).

6. The child resistant medicament storage and distribution package (10) of claim 5, wherein the dispensing substrate initiation region perimeter (242) includes a portion of that is a dispensing substrate initiation region breakaway edge (243) that initially secures the dispensing substrate initiation region (240) to the dispensing substrate (200) until the first force reaches a predetermined magnitude causing the breakaway edge (243) to release from the remainder of the dispensing substrate (200) and pivot about the dispensing substrate initiation region retaining edge (244), thereby allowing a portion of the gate (340) to pass a void in the dispensing substrate (200) previously occupied by the dispensing substrate initiation region (240).

7. The child resistant medicament storage and distribution package (10) of claim 1, wherein application of the first force to the portion of the gate (340) results in a portion of the gate (340) extending through the backing substrate initiation region (430) resulting in movement of the gate free edge (343) such that the gate (340) does not block access to the article dispensing region (440).

8. The child resistant medicament storage and distribution package (10) of claim 7, wherein the backing substrate initiation region (430) defines a void formed in the backing substrate (400) sized to cooperate with the gate (340) such that application of the first force results in a portion of the gate (340) extending through the backing substrate initiation region (430).

9. The child resistant medicament storage and distribution package (10) of claim 7, wherein the backing substrate initiation region (430) is an integral portion of the backing substrate (400) and has a backing substrate initiation region perimeter (432), a portion that is a backing substrate initiation region retaining edge (434) that secures the backing substrate initiation region (430) to the backing substrate (400) and serves as a line about which the backing substrate initiation region (430) may pivot as a portion of the gate (340) is forced through a void in the backing substrate (400) previously occupied by the backing substrate initiation region (430).

10. The child resistant medicament storage and distribution package (10) of claim 9, wherein the backing substrate initiation region perimeter (432) includes a portion of that is a backing substrate initiation region breakaway edge (433) that initially secures the backing substrate initiation region (430) to the backing substrate (400) until the first force reaches a predetermined magnitude causing the breakaway edge (433) to release from the remainder of the backing substrate (400) and pivot about the backing substrate initiation region retaining edge (434), thereby allowing a portion of the gate (340) to pass a void in the backing substrate (400) previously occupied by the backing substrate initiation region (430).

11. The child resistant medicament storage and distribution package (10) of claim 1, wherein the backing substrate article dispensing region (440) defines a void formed in the backing substrate (400) sized to cooperate with the medicament (M) so that the medicament (M) may pass through the article dispensing region (440) for distribution.

12. The child resistant medicament storage and distribution package (10) of claim 1, wherein the backing substrate article dispensing region (440) is an integral portion of the backing substrate (400) having a separation line (444) selectively reducing the strength of the backing substrate (400), thereby permitting the medicament (M) to break a portion of the article dispensing region (440) free of the backing substrate (400) along the separation line (444) when the medicament (M) is exposed to the second force, thereby permitting the medicament (M) to pass through the article dispensing region (440) for distribution.

13. The child resistant medicament storage and distribution package (10) of claim 12, wherein the separation line (444) is located substantially on the article dispensing region perimeter (442).

14. The child resistant medicament storage and distribution package (10) of claim 13, wherein the separation line (444) comprises one or more of the group consisting of die cuts, perforations, indentations, score lines, and weakened fracture lines.

15. The child resistant medicament storage and distribution package (10) of claim 1, wherein the blocking substrate (300) and the backing substrate (400) are comprised of a material and thickness that cannot be readily ruptured by a human finger pushing on the medicament (M) in the article receiving blister (190).

16. The child resistant medicament storage and distribution package (10) of claim 1, wherein the dispensing substrate initiation region (240) and the backing substrate initiation region (430) are sized to cooperate with the dimensions of a tip of a human finger.

17. The child resistant medicament storage and distribution package (10) of claim 16, wherein the dispensing substrate initiation region (240) and the backing substrate initiation region (430) are between approximately 0.12 square inches and approximately 0.5 square inches.

18. A child resistant medicament storage and distribution package (10) for housing a medicament (M), comprising:

(a) a blister portion (100) having:

(i) a base layer (110) having a base layer perimeter (120), a base layer exterior surface (130), and a base layer interior surface (140);

(ii) a blister layer (150) having a blister layer perimeter (160), a blister layer exterior surface (170), a blister layer interior surface (180), and including an article receiving blister (190), having a blister perimeter (196), formed therein, wherein the article receiving blister (190) is designed for holding the medicament (M); wherein (iii) at least five percent of the surface area of the base layer interior surface (130) is joined to the blister layer interior surface (180) thereby sealing the medicament (M) in the article receiving blister (190);

(b) a dispensing substrate (200) having a dispensing substrate perimeter (201), a dispensing substrate interior surface (210), and a dispensing substrate exterior surface (220), wherein the dispensing substrate (200) is formed to have:

(i) a dispensing substrate blister receiver (230) configured to cooperate with the blister portion (100) such that a portion of the article receiving blister (190) extends through the dispensing substrate (200) from the dispensing substrate interior surface (210) to the dispensing substrate exterior surface (220); and (ii) a dispensing substrate initiation region (240) integral to the dispensing substrate (200) and having a dispensing substrate initiation region perimeter (242) with (a) a portion that is a dispensing substrate initiation region retaining edge (244) that secures the dispensing substrate initiation region (240) to the dispensing substrate (200) and serves as a line about which the dispensing substrate initiation region (240) may pivot, and (b) a portion that is a dispensing substrate initiation region breakaway edge (243) that initially secures the dispensing substrate initiation region (240) to the dispensing substrate (200) until acted upon by a force of a predetermined magnitude that causes the breakaway edge (243) to release from the remainder of the dispensing substrate (200);

(c) a blocking substrate (300) having a blocking substrate perimeter (301), a blocking substrate front surface (310), and a blocking substrate rear surface (320), wherein the blocking substrate (300) includes a gate (340) having a gate perimeter (342) including a gate free edge (343) and a gate retaining edge (348);

(d) a backing substrate (400) having a backing substrate perimeter (401), a backing substrate interior surface (410), and a backing substrate exterior surface (420), wherein the backing substrate (400) is formed to have:

(i) a backing substrate initiation region (430) integral to the backing substrate (400) and having a backing substrate initiation region perimeter (432) with (a) a portion that is a backing substrate initiation region retaining edge (434) that secures the backing substrate initiation region (430) to the backing substrate (400) and serves as a line about which the backing substrate initiation region (430) may pivot, and (b) a portion that is a backing substrate initiation region breakaway edge (433) that initially secures the backing substrate initiation region (430) to the backing substrate (400) until acted upon by a force of a predetermined magnitude causing the breakaway edge (433) to release from the remainder of the backing substrate (400); and (ii) an article dispensing region (440) having an article dispensing region perimeter (442), wherein the article dispensing region (440) is configured to cooperate with the blister portion (100); and (e) wherein the blister portion blister layer (150) is adjacent to the dispensing substrate interior surface (210), the blocking substrate front surface (310) is adjacent to the blister portion base layer (110), and the backing substrate interior surface (410) is adjacent to the blocking substrate rear surface (320) such that the dispensing substrate blister receiver (230), the article receiving blister (190), and the article dispensing region (440) substantially align, and the gate (340) is initially located between the article dispensing region (440) and the article receiving blister (190) to prevent unintentional dispensing of the medicament (M), such that dispensing of the medicament (M) requires application of a first force to a portion of the gate (340) resulting in the gate free edge (343) sliding toward the gate retaining edge (348) and past the article dispensing region (440) such that application of a second force to the article receiving blister (190) forces the medicament (M) to break through the base layer (110), pass through an opening in the blocking substrate (300) created by the movement of the gate (340), and out the article dispensing region (440).

19. The child resistant medicament storage and distribution package (10) of claim 18, wherein the gate (340) has a fold promoting characteristic (350) that causes the gate (340) to begin to fold about the fold promoting characteristic (350) when the gate (340) is displaced out of the plane of the package (10) by the first force, thereby creating a pivot projection (352) that is easily pivoted about the gate retaining edge (348) and away from the article receiving blister (190) drawing the gate free edge (343) past the article receiving blister (190) to permit dispensing of the medicament (M).

20. The child resistant medicament storage and distribution package (10) of claim 18, wherein application of the first force to the portion of the gate (340) results in a portion of the gate (340) extending through the dispensing substrate initiation region (240) resulting in movement of the gate free edge (343) such that the gate (340) does not block access to the article dispensing region (440).

21. The child resistant medicament storage and distribution package (10) of claim 18, wherein application of the first force to the portion of the gate (340) results in a portion of the gate (340) extending through the backing substrate initiation region (430) resulting in movement of the gate free edge (343) such that the gate (340) does not block access to the article dispensing region (440).

22. The child resistant medicament storage and distribution package (10) of claim 18, wherein the backing substrate article dispensing region (440) defines a void formed in the backing substrate (400) sized to cooperate with the medicament (M) so that the medicament (M) may pass through the article dispensing region (440) for distribution.

23. The child resistant medicament storage and distribution package (10) of claim 18, wherein the backing substrate article dispensing region (440) is an integral portion of the backing substrate (400) having a separation line (444) selectively reducing the strength of the backing substrate (400), thereby permitting the medicament (M) to break a portion of the article dispensing region (440) free of the backing substrate (400) along the separation line (444) when the medicament (M) is exposed to the second force, thereby permitting the medicament (M) to pass through the article dispensing region (440) for distribution.

24. The child resistant medicament storage and distribution package (10) of claim 23, wherein the separation line (444) is located substantially on the article dispensing region perimeter (442).

25. The child resistant medicament storage and distribution package (10) of claim 18, wherein the blocking substrate (300) and the backing substrate (400) are comprised of a material and thickness that cannot be readily ruptured by a human finger pushing on the medicament (M) in the article receiving blister (190).

26. The child resistant medicament storage and distribution package (10) of claim 18, wherein the dispensing substrate initiation region (240) and the backing substrate initiation region (430) are sized to cooperate with the dimensions of a tip of a human finger.

27. The child resistant medicament storage and distribution package (10) of claim 26, wherein the dispensing substrate initiation region (240) and the backing substrate initiation region (430) are between approximately 0.12 square inches and approximately 0.5 square inches.

28. A medicament storage and distribution package (10) for housing a medicament (M), comprising:

(a) a blister portion (100) having:

(i) a base layer (110) having a base layer perimeter (120), a base layer exterior surface (130), and a base layer interior surface (140);

(ii) a blister layer (150) having a blister layer perimeter (160), a blister layer exterior surface (170), a blister layer interior surface (180), and including an article receiving blister (190), having a blister perimeter (196), formed therein, wherein the article receiving blister (190) is designed for holding the medicament (M); wherein (iii) at least five percent of the surface area of the base layer interior surface (130) is joined to the blister layer interior surface (180) thereby sealing the medicament (M) in the article receiving blister (190);

(b) a dispensing substrate (200) having a dispensing substrate perimeter (201), a dispensing substrate interior surface (210), and a dispensing substrate exterior surface (220), wherein the dispensing substrate (200) is formed to have:

(i) a dispensing substrate blister receiver (230) configured to cooperate with the blister portion (100) such that a portion of the article receiving blister (190) extends through the dispensing substrate (200) from the dispensing substrate interior surface (210) to the dispensing substrate exterior surface (220); and (ii) a dispensing substrate initiation region (240), sized to cooperate with the dimensions of a tip of a human finger, integral to the dispensing substrate (200) and having a dispensing substrate initiation region perimeter (242) with (a) a portion that is a dispensing substrate initiation region retaining edge (244) that secures the dispensing substrate initiation region (240) to the dispensing substrate (200) and serves as a line about which the dispensing substrate initiation region (240) may pivot, and (b) a portion that is a dispensing substrate initiation region breakaway edge (243) that initially secures the dispensing substrate initiation region (240) to the dispensing substrate (200) until acted upon by a force of a predetermined magnitude that causes the breakaway edge (243) to release from the remainder of the dispensing substrate (200);

(c) a blocking substrate (300) having a blocking substrate perimeter (301), a blocking substrate front surface (310), and a blocking substrate rear surface (320), wherein the blocking substrate (300) includes a gate (340) having a gate perimeter (342) including a gate free edge (343) and a gate retaining edge (348), wherein the gate (340) has a fold promoting characteristic (350) that causes the gate (340) to begin to fold about the fold promoting characteristic (350) when the gate (340) is displaced out of the plane of the package (10) by the first force, thereby creating a pivot projection (352) that is easily pivoted about the gate retaining edge (348) and away from the article receiving blister (190) drawing the gate free edge (343) past the article receiving blister (190) to permit dispensing of the medicament (M);

(d) a backing substrate (400) having a backing substrate perimeter (401), a backing substrate interior surface (410), and a backing substrate exterior surface (420), wherein the backing substrate (400) is formed to have:

(i) a backing substrate initiation region (430), sized to cooperate with the dimensions of a tip of a human finger, integral to the backing substrate (400) and having a backing substrate initiation region perimeter (432) with (a) a portion that is a backing substrate initiation region retaining edge (434) that secures the backing substrate initiation region (430) to the backing substrate (400) and serves as a line about which the backing substrate initiation region (430) may pivot, and (b) a portion that is a backing substrate initiation region breakaway edge (433) that initially secures the backing substrate initiation region (430) to the backing substrate (400) until acted upon by a force of a predetermined magnitude causing the breakaway edge (433) to release from the remainder of the backing substrate (400); and (ii) an article dispensing region (440) having an article dispensing region perimeter (442), wherein the article dispensing region (440) is configured to cooperate with the blister portion (100) and the article dispensing region (440) is an integral portion of the backing substrate (400) having a separation line (444) located substantially on the article dispensing region perimeter (442) to selectively reducing the strength of the backing substrate (400), thereby permitting the medicament (M) to break a portion of the article dispensing region (440) free of the backing substrate (400) along the separation line (444) when the medicament (M) is exposed to the second force, thereby permitting the medicament (M) to pass through the article dispensing region (440) for distribution; and (e) wherein the blister portion blister layer (150) is adjacent to the dispensing substrate interior surface (210), the blocking substrate front surface (310) is adjacent to the blister portion base layer (110), and the backing substrate interior surface (410) is adjacent to the blocking substrate rear surface (320) such that the dispensing substrate blister receiver (230), the article receiving blister (190), and the article dispensing region (440) substantially align, and the gate (340) is initially located between the article dispensing region (440) and the article receiving blister (190) to prevent unintentional dispensing of the medicament (M), such that dispensing of the medicament (M) requires application of a first force to a portion of the gate (340) resulting in the gate free edge (343) sliding toward the gate retaining edge (348) and past the article dispensing region (440) such that application of a second force to the article receiving blister (190) forces the medicament (M) to break through the base layer (110), pass through an opening in the blocking substrate (300) created by the movement of the gate (340), and out the article dispensing region (440).

29. The child resistant medicament storage and distribution package (10) of claim 28, wherein application of the first force to the portion of the gate (340) results in a portion of the gate (340) extending through the dispensing substrate initiation region (240) resulting in movement of the gate free edge (343) such that the gate (340) does not block access to the article dispensing region (440).

30. The child resistant medicament storage and distribution package (10) of claim 28, wherein application of the first force to the portion of the gate (340) results in a portion of the gate (340) extending through the backing substrate initiation region (430) resulting in movement of the gate free edge (343) such that the gate (340) does not block access to the article dispensing region (440).

31. The child resistant medicament storage and distribution package (10) of claim 28, wherein the blocking substrate (300) and the backing substrate (400) are comprised of a material and thickness that cannot be readily ruptured by a human finger pushing on the medicament (M) in the article receiving blister (190).

* * * * *